US009228808B2

(12) United States Patent
Brundula et al.

(10) Patent No.: US 9,228,808 B2
(45) **Date of Patent: *Jan. 5, 2016**

(54) SYSTEMS AND METHODS FOR DETECTING CARTRIDGE DESCRIPTION

(75) Inventors: Steven N. D. Brundula, Chandler, AZ (US); Milan Cerovic, Phoenix, AZ (US); Magne H. Nerheim, Paradise Valley, AZ (US)

(73) Assignee: TASER International, Inc., Scottsdale, AZ (US)

( * ) Notice: Subject to any disclaimer, the term of this patent is extended or adjusted under 35 U.S.C. 154(b) by 1344 days.

This patent is subject to a terminal disclaimer.

(21) Appl. No.: 12/970,000

(22) Filed: Dec. 16, 2010

(65) Prior Publication Data

US 2012/0257320 A1 Oct. 11, 2012

Related U.S. Application Data

(63) Continuation of application No. 12/828,157, filed on Jun. 30, 2010, now Pat. No. 8,356,438, which is a continuation-in-part of application No. 11/428,892, filed on Jul. 6, 2006, now Pat. No. 7,900,388.

(60) Provisional application No. 60/716,809, filed on Sep. 13, 2005.

(51) Int. Cl.

| | |
|---|---|
| ***F41B 15/04*** | (2006.01) |
| ***F41H 13/00*** | (2006.01) |
| ***F41A 17/06*** | (2006.01) |
| ***H05C 1/06*** | (2006.01) |

(52) U.S. Cl.

CPC ..... *F41H 13/0025* (2013.01); *F41A 17/063* (2013.01); *F41H 13/0018* (2013.01); *F41H 13/0031* (2013.01); *H05C 1/06* (2013.01)

(58) Field of Classification Search

CPC . F41H 13/00; F41H 13/0012; F41H 13/0025; F41H 13/018; F41H 13/0031; H05C 1/06; F41A 17/063; F41A 17/066

USPC ..... 42/1.08, 84; 361/232; 89/1.11

See application file for complete search history.

(56) References Cited

U.S. PATENT DOCUMENTS

| | | | |
|---|---|---|---|
| 4,884,809 | A | 12/1989 | Rowan |
| 4,893,815 | A | 1/1990 | Rowan |
| 5,041,951 | A | 8/1991 | Fan |
| 5,465,687 | A | 11/1995 | Custer |
| 5,685,636 | A | 11/1997 | German |
| 5,962,806 | A | 10/1999 | Coakley |

(Continued)

OTHER PUBLICATIONS

Murray, John et al., "A Guide to TASER Technology", 1997, 1st Edition, Whitewater Press, Whitewater, Colorado, pp. 21-99, 109-143, and 224-233.

(Continued)

*Primary Examiner* — Bret Hayes
(74) *Attorney, Agent, or Firm* — Lawrence Letham

(57) ABSTRACT

An apparatus, according to various aspects of the present invention, produces contractions in skeletal muscles of a target to impede locomotion by the target. The apparatus is used with a provided deployment unit that deploys an electrode away from the apparatus. The electrode conducts a current through the target. The apparatus includes a detector that detects indicia describing the deployment unit and a processing circuit that performs a function of the launch device in accordance with the indicia.

42 Claims, 19 Drawing Sheets

(56) References Cited

U.S. PATENT DOCUMENTS

| | | | | |
|---|---|---|---|---|
| 6,564,687 | B2 | 5/2003 | Poole | |
| 6,791,816 | B2 | 9/2004 | Stethem | |
| 6,933,851 | B2 | 8/2005 | Hahne | |
| 7,600,337 | B2 * | 10/2009 | Nerheim et al. | 42/1.08 |
| 7,631,452 | B1 | 12/2009 | Brundula | |
| 7,673,411 | B1 | 3/2010 | Baldwin | |
| 7,778,004 | B2 | 8/2010 | Nerheim | |
| 7,800,885 | B2 | 9/2010 | Brundula | |
| 7,900,388 | B2 | 3/2011 | Brundula | |
| 7,944,676 | B2 | 5/2011 | Smith | |

OTHER PUBLICATIONS

National Research Council, "7. Alternatives Potentially Available After 2006," Alternative Technologies to Replace Antipersonnel Landmines. Washington, DC: The National Academies Press, 2001. 1. Print., pp. 60-76. http://www.nap.edu/openbook.php?record_id=10071&page=60.

* cited by examiner

SYSTEMS AND METHODS FOR DETECTING CARTRIDGE DESCRIPTION

CROSS-REFERENCE TO RELATED APPLICATIONS

This application is a continuation of and claims priority from U.S. Non-Provisional patent application Ser. No. 12/828,157 to Brundula, et al. filed Jun. 30, 2010, now U.S. Pat. No. 8,356,438 which is a Continuation-In-Part of U.S. Non-Provisional patent application Ser. No. 11/428,892 to Brundula, et al. filed Jul. 6, 2006, now U.S. Pat. No. 7,900,388 which claims the benefit of U.S. Provisional Patent Application 60/716,809 to Nerheim, et al. filed Sep. 13, 2005.

FIELD OF THE INVENTION

Embodiments of the present invention relate to weaponry including electronic control devices.

BACKGROUND OF THE INVENTION

Conventional electronic weaponry includes, for example, contact stun devices, batons, shields, stun guns, hand guns, rifles, mortars, grenades, projectiles, mines, and area protection devices among other apparatus generally suitable for ensuring compliance with security and law enforcement. This type of weaponry when used against a human or animal target causes an electric current to flow through part of the target's tissue to interfere with the target's use of its skeletal muscles. All or part of an electronic circuit may be propelled toward the target. In an important application of electronic weaponry, terrorists may be stopped in assaults and prevented from completing acts involving force to gain unlawful control of facilities, equipment, operators, innocent citizens, and law enforcement personnel. In other important applications of electronic weaponry, suspects may be arrested by law enforcement officers, and the cooperation of persons in custody may be maintained by security officers. An electronic weapon generally includes a circuit that generates a stimulus signal and one or more electrodes. In operation, for example to stop a terrorist act, the electrodes are propelled from the electronic weaponry toward the person to be stopped or controlled. After impact, a pulsing electric current is conducted between the electrodes sufficient for interfering with the person's use of his or her skeletal muscles. Interference may include involuntary, repeated, intense, muscle contractions at a rate of 5 to 20 contractions per second.

Research has shown that the intensity of the muscle contractions and the extent of the body affected with muscle contractions depend on several factors including the extent of the body conducting, charged, or discharged by the pulsing electric current. The extent is generally greater with increased distance between the electrodes. A minimum suitable distance is typically about 7 inches. Prior to propulsion, electrodes are typically stored much closer together and spread apart in flight toward the target. It is desirable to improve the accuracy with which the electrodes strike the target.

Conventional electronic weaponry is intended for a limited number of applications. A user interface capable of multiple functions as well as weaponry capable of multiple functions are desired. For anti-terrorism, law enforcement, and security, the arrest and control of multiple targets in a single confrontation is an important application where a single weapon with multiple functions is desirable.

BRIEF DESCRIPTION OF THE DRAWING

Embodiments of the present invention will now be further described with reference to the drawing, wherein like designations denote like elements, and.

DETAILED DESCRIPTION OF THE PREFERRED EMBODIMENTS

Figure 1A:
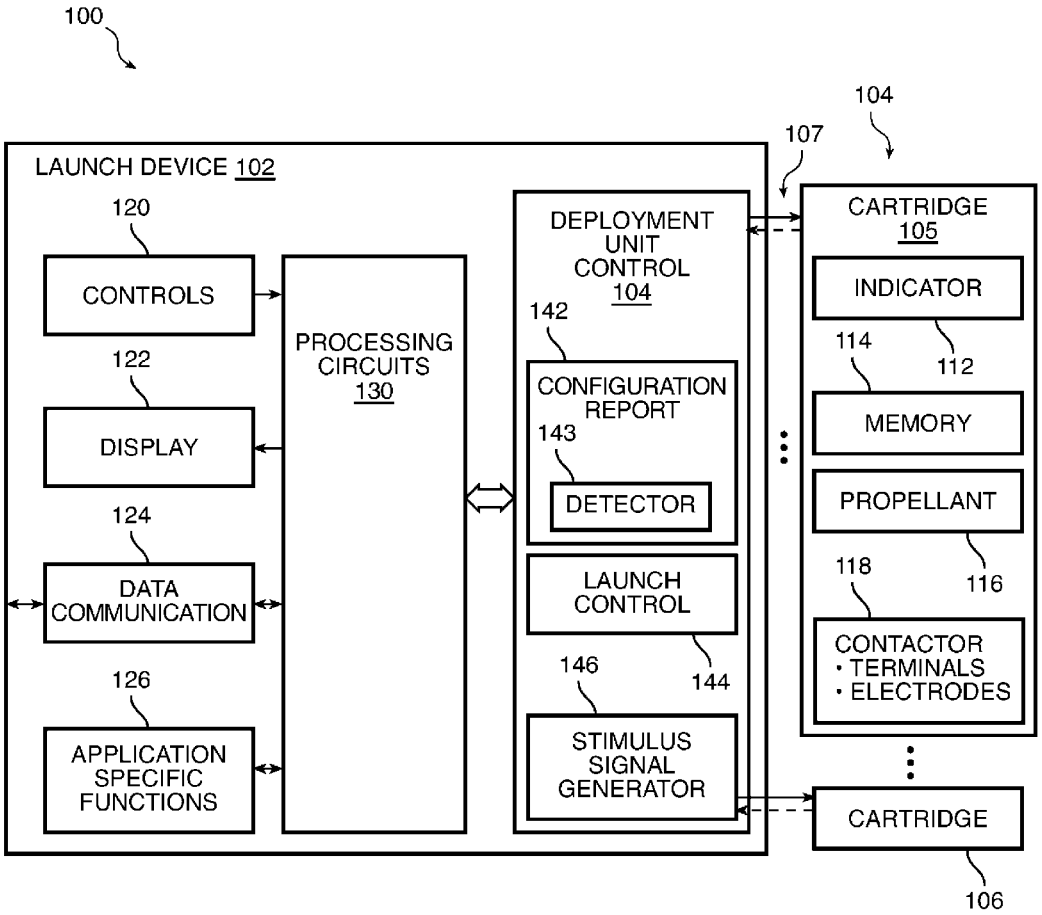
FIGS. 1A and 1B are functional block diagrams of an electronic weapon system according to various aspects of the present invention.

Greater utility and improved accuracy of electronic weapon systems can be obtained by eliminating several problems exhibited by conventional electronic weapon systems. A conventional electronic weapon may perform a contact (or proximate) stun function (also called a local stun function) of subduing an animal or person (herein called a target) by abutting (or bringing proximate) at least two terminals of the weapon to the skin or clothing of the target. Another conventional electronic weapon may perform a remote stun function of subduing a target by launching one or more wire tethered electrodes from the weapon to the target so that the electrodes are proximate to or impale the skin or clothing of the target. In either the local stun function or the remote stun function, an electric circuit is formed for passing a pulsing current through a portion of the tissue of the target to interfere with skeletal muscle control by the target. When a terminal or an electrode is proximate to the tissue of the target, air is ionized from the electrode to the tissue to complete a circuit for current to flow through the tissue of the target.

An electronic weapon system according to various aspects of the present invention may perform alternatively the local stun function and the remote stun function without operator intervention to mechanically reconfigure the electronic weapon system. The local stun function is available at the front face of the weapon system whether or not a cartridge (e.g., spent, used, fired, deployed or unspent, unused, unfired, undeployed) is loaded. Multiple unspent cartridges may be loaded individually, by a clip, or by a magazine prior to use of the electronic weapon system to provide multiple operations of the remote stun function.

Electrodes, tether wires, and a propellant system are conventionally packaged as a cartridge that is mounted on the electronic weapon to form an electronic weapon system for a single remote stun use. After deployment of the electrodes, the spent (e.g., used, launched, fired, deployed) cartridge may be removed from the electronic weapon and replaced with another cartridge. A cartridge may include several electrodes launched at once as a set, launched at various times as sets, or individually launched. A cartridge may have several sets of electrodes each for independent launch in a manner similar to a magazine.

An electronic weapon system according to various aspects of the present invention maintains several cartridges ready for use. If, for example, a first attempted remote stun function is not successful (e.g., an electrode misses the target or the electrodes short together), a second cartridge may be used without operator intervention to mechanically reconfigure the electronic weapon system. Several cartridges may be mounted simultaneously (e.g., as a clip or magazine), or sequentially (e.g., any cartridge, whether used or unused, may be removed and replaced independently of the other cartridges).

Accuracy of a remote stun function is dependent on, among other things, a repeatable trajectory of each electrode launched away from the electronic weapon. A conventional cartridge includes a delivery cavity for holding the electrode prior to delivery and for guiding the electrode during the early moments of deployment. Deployment is conventionally accomplished by a sudden release of gas (e.g., pyrotechnic gas production and/or rupture of a cylinder of compressed gas). The electrode and the delivery cavity are kept free of contamination by being tightly covered. When the electrode is deployed, it pulls its wire tether from a wire store so that the wire tether extends behind the electrode to the weapon during flight.

A conventional cartridge may be constructed to provide a suitable range of effective distance. The range of effective distance provides a suitable spread of electrodes (e.g., greater than about 6 inches (15 cm)) on impact with the target when the target exists at a specified range of distances from the weapon (e.g., from about 6 to about 15 feet (2 m to 5 m)).

An electronic weapon system, according to various aspects of the present invention, supports use of a set of cartridges each having a different range of effective distance in part due to each cartridge (or magazine) providing to the weapon various indicia of its capabilities (or codes from which capabilities may be determined). A cartridge, a clip, and a magazine are particular examples of apparatus generally referred to herein as a deployment unit. The electronic weapon system may be operated to launch a particular cartridge (or particular electrode set of a cartridge having several sets of electrodes) suitable for a particular application of the remote stun function.

An electronic weapon and/or a user of an electronic weapon may select a particular cartridge as a presently selected cartridge. Cartridge selection may include selecting one cartridge, whether used or unused, from one or more cartridges of a set of cartridges. Selection of a next cartridge as the presently selected cartridge may be automatic, responsive to a launch of the electrodes from the presently selected cartridge. Selection of a next cartridge as the presently selected cartridge may be responsive to operation of a control by the user.

Greater utility and/or improved accuracy as discussed above are accomplished by an electronic weapon system constructed and operated according to various aspects of the present invention. For example and for clarity of presentation, consider electronic weapon system 100 of FIGS. 1-17. Electronic weapon system 100 includes launch device 102 cooperating with a set (e.g., one or more) of cartridges 104. The cartridges 104 may be separate units or a mechanical assembly of cartridges. In either configuration, the set of cartridges is herein called a deployment unit 104. Deployment unit 104 comprises a set of cartridges 105 and 106 that may be mounted to launch device 102 individually or as a set, for example, in one or more clips or magazines. Deployment unit 104 may include one or more cartridges (e.g., 1, 2, 3, 4, 5, 6, or more). When each cartridge is spent, that cartridge may be replaced individually. A spent cartridge may be retained in an electronic weapon to provide an additional stimulus signal as described herein. Cartridges in deployment unit 104 may be identical or may vary (e.g., inter alia, in capabilities, manufacturer, manufacturing date).

A launch device includes any device for operating one or more deployment units. A launch device may be packaged as a contact stun device, baton, shield, stun gun, hand gun, rifle, mortar, grenade, projectile, mine, or area protection device. For example, a gun type launch device may be hand-held by an operator to operate one or more cartridges at a time from a set or magazine of cartridges. A mine type launch device (also called an area denial device) may be remotely operated (or operated by a sensor such as a trip wire) to launch one or more cartridges substantially simultaneously. A grenade type launch device may be operated from a timer to launch one or more cartridges substantially simultaneously. A projectile type launch device may be operated from a timer or target sensor to launch plural electrode sets at multiple targets. The functions of these various launch devices may be understood from a functional block diagram applicable to these launch devices.

For example, the functional block diagram of FIG. 1A shows a launch device 102 that includes controls 120, display 122, data communication 124, application specific functions 126, processing circuits 130, and deployment unit control 140. Deployment unit control 140 includes configuration report function 142 having a detector function 143 (e.g., having one or more detectors), launch control function 144, and stimulus signal generator 146. Components of launch device 102 cooperate to provide all of the functions discussed above. Other combinations of less than all of these functions may be implemented according to the present invention. A deployment unit 104 in implementations according to various aspects of the present invention may include one or more cartridges, one or more magazines, and/or one or more clips of cartridges. A weapon system according to various aspects of the present invention may include one or more physically separate deployment units for example for redundancy, back up, or for an array covering an area.

Launch device 102 communicates with each cartridge 105 and 106 of deployment unit 104 via an electrical interface 107. By interface 107, launch device 102 may provide power, launch control signals, and stimulus signals to each cartridge. Various ones of these signals may be in common or (preferably) unique to each cartridge. Each cartridge 105 and 106 may provide signals to launch device 102 that convey indicia, for example, of capabilities, as discussed above and described further below.

Launch device 102 in various forms as discussed above includes controls operated by the target (e.g., an area denial device), by an operator (e.g., a handgun type device), or by timing or sensor circuits (e.g., a grenade type device). A control includes any conventional manual or automatic interface circuit, such as a manually operated switch or relay. Controls may be implemented using a graphical user interface (e.g., a graphical display, a pointing device, or a touch screen display).

Figure 1B:
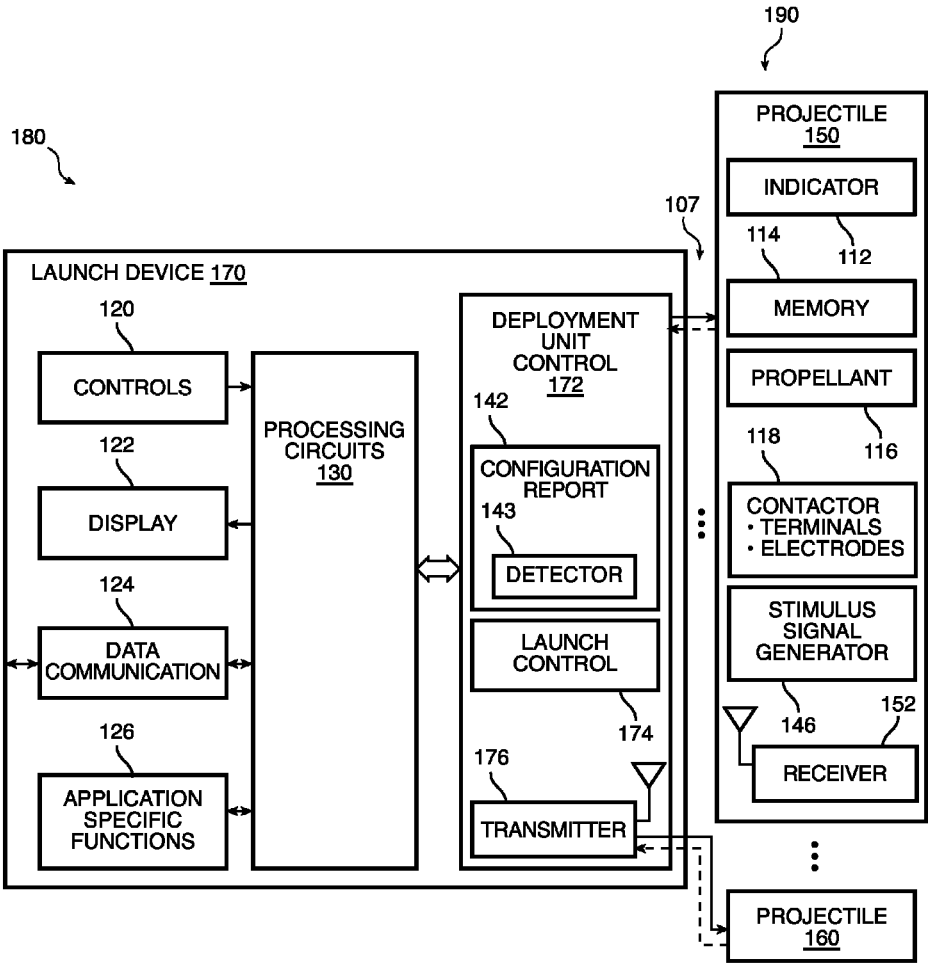

In another example, the functional block diagram of FIG. 1B shows a launch device 170 that includes controls 120, display 122, data communication 124, application specific functions 126, processing circuits 130, and deployment unit control 172. Deployment unit control 172 includes configuration report function 142 having a detector function 143 (e.g., having one or more detectors), launch control function 174, and transmitter 176. Components of launch device 170 cooperate to launch and control projectiles 150-160. Components of launch device 170 cooperate to provide some or all of the functions discussed above.

A deployment unit 190 in implementations according to various aspects of the present invention may include one or more projectiles, one or more magazines of projectiles, and/or one or more clips of projectiles.

Launch device 170 communicates with each projectile 150 and 160 of deployment unit 190 via an electrical interface 107. By interface 107, launch device 170 may provide power and launch control signals to each projectile until launch. Various ones of the signals of interface 107 may be in common or (preferably) unique to each projectile. Each projectile 150 and 160 may provide signals to launch device 170 that convey indicia, for example, of capabilities as discussed herein and an address. After launch, the signal provided via interface 107 to a launched projectile is discontinued due to separation of the projectile from launch device 170; however, communication between launch device 170 and any projectile 150-160 may continue via transmitter 176 of deployment control 172 and each respective receiver 152 of each projectile.

Controls 120, display 122, data communication 124, processing circuits 130, configuration report 142, detector 143, indicator 112, memory 114, propellant 116, contactor 118, and stimulus signal generator 146 of launch device 170 and projectiles 150-160 may perform the same functions as discussed for components of weapon 100 having the same number. Launch device 170 may be operated by a user of weapon 180, a target, or a timing or sensor circuit.

For a handgun type device that launches wire-tethered electrodes and/or projectiles, controls 120 may include any one or more of a safety control, a trigger control, a range priority control, a stimulate control, and a select control. A control may perform one or more functions. A function performed by an operation of a control may further depend on a configuration of the electronic weapon as discussed below. Any control discussed herein may be combined with any other control to perform some or all of the functions of the separate controls.

A safety control (e.g., binary switch) may be read by processing circuits 130 and effect a general enablement or disablement of launch control 144 (174) and stimulus circuitry 146. A trigger control may be read by processing circuits 130 to effect operation of a propellant (116) in a particular cartridge (e.g., 105, 106) and/or projectile (e.g., 150, 160).

A range priority control may be read by processing circuits 130 and effect selection by the processor of a cartridge to operate in response to a next operation of a trigger control in accordance with a range of effective distance for the intended application indicated by the range priority control.

A stimulate control, when operated, may initiate another delivery of one or more stimulus signals for a local stun function via terminals of the launch device 102 (not shown), via contactor 118 of a cartridge 105-106, or a projectile 150-160. The contactor 118 may deliver the additional stimulus signals via terminals of the cartridge and/or projectile for a local stun function or via launched electrodes for a remote stun function. For an electronic weapon having two or more cartridges and/or projectiles, a stimulate control may deliver additional stimulus signals via launched electrodes of used cartridges, additional stimulus signals via terminals of a launched projectile, and an arc via terminals of unused cartridges. An arc may be used to provide a local stun. An arc may provide a display. A display may warn a target. A stimulate control may further select one cartridge from one or more cartridges of a set of cartridges or one projectile from one or more projectiles of a set of projectiles as discussed herein. A cartridge may be selected to launch wire-tethered electrodes, provide an additional stimulus signal via launched electrodes of the cartridge, or provide an arc between terminals of the cartridge. A projectile may be selected to launch and to provide an additional stimulus signal via terminals of the projectile.

A select control may select a configuration of an electronic weapon. A configuration of an electronic weapon may determine an operation performed by a weapon. A configuration of an electronic weapon may determine an operation performed responsive to an operation of a control. In an implementation, a select control selects whether an electronic weapon is configured to automatically select a next cartridge (projectile) or to require a user to manually select a next cartridge (projectile) of a set of cartridges (projectiles).

For example, an electronic weapon may operate in a manual configuration or an automatic configuration. In an automatic configuration, operation of a trigger launches wire-tethered electrodes from a presently selected cartridge and selects a next cartridge from the unspent cartridges of the set as a next selected cartridge. In a weapon that includes projectiles, in the automatic configuration, operation of a trigger launches a presently selected projectile and selects a next unused projectile as the next selected projectile. Once all cartridges (projectiles) of the set are used, a further operation of the trigger does not select a next cartridge (projectile), but provides an additional stimulus signal via the launched electrodes of the last selected cartridge or via the terminals of the last selected cartridge.

In a manual configuration, a user operates a control (e.g., stimulate) to select one cartridge from the set of cartridges as a next selected cartridge. A user may select a spent or an unspent cartridge. The operation performed by a trigger control while in the manual configuration depends on whether the presently selected cartridge is spent or unspent. When the control is operated by a user to select a spent cartridge, an operation of the trigger control provides an additional stimulus signal to the launched electrodes of the presently selected cartridge. Operation of the trigger while an unspent cartridge is selected as the presently selected cartridge initiates a launch of the electrodes of the unspent cartridge and provision of a stimulus signal via the launched electrodes.

In a manual configuration for a weapon that launches projectiles, a user operates a control (e.g., stimulate) to select one projectile from the set of projectiles as a next selected projectile. A user may select a launched projectile or an unlaunched projectile. The operation performed by a trigger control while in the manual configuration depends on whether the presently selected projectile is launched or unlaunched. When the control is operated by a user to select a launched projectile, an operation of the trigger control provides an additional stimulus signal to the terminals of the presently selected projectile. Operation of the trigger while an un-launched projectile is selected as the presently selected cartridge initiates a launch of the projectile and provision of a stimulus signal via terminals of the projectile.

In an implementation, the functions of a select control and a stimulate control are performed by a single control. While the safety is on, the single control performs the operations of a select control. While the safety is off, the single control performs the operations of a stimulate control. Operation of a control may perform further functions in accordance with a duration of time the control is activated (e.g., pressed, set, held) by a user. For example, pressing the control for a shorter duration (e.g., <200 ms) performs one function while pressing the control for a longer duration (e.g., >=200 ms) performs another function as discussed below.

A control may be implemented using any indicator/detector discussed herein. Such an implementation may facilitate maintaining a hermetic seal of the launch device. For example, the safety, trigger, range priority, select, and/or stimulate controls may be implemented with a magnet that moves with the manual movement portion of the control and a reed switch located inside the hermetic seal of the launch device that detects the position and/or movement of the magnet.

A display provides presentations of information and may further present icons for controls as discussed above. Any conventional display may be used. For example, display 122 receives information from processing circuits 130, presents the information to an operator of launch device 102, and may receive inputs (e.g., touch screen functions) reported back to processing circuits 130. A presentation of information may include information about the cartridges of a set of cartridges. Information may include which cartridge of the set is presently selected, which cartridges have been used, which cartridges are unused, and which cartridge will be the next cartridge to be selected as the presently selected cartridge in accordance with the automatic and manual configurations discussed above.

A data communication function performs wired and/or wireless sending and receiving of data using any conventional protocols and circuits. Via data communications, processing circuits 130 may receive software to be performed by processing circuits 130, presentations for display 122, updated configuration information describing launch device 102 and/or deployment units 104. Data gathered by processing circuits 130 may be reported via data communication.

An application specific function communicates with processing circuits 130 to facilitate more effective use of launch device 102 in a particular application or type of applications. Application specific functions 126 may provide software to processing circuits 130 and include sensors and I/O devices. The warning, local stun, and remote stun functions are referred to herein as primary functions.

A processing circuit includes any circuit for performing functions in accordance with a stored program. For example, processing circuits 130 may include a processor and memory, and/or a conventional sequential machine that executes microcode or assembly language instructions from memory. Processing circuits may include one or more microprocessors, microcontrollers, application specific integrated circuits, digital signal processors, programmable gate arrays, or programmable logic devices.

A configuration report function includes any function that collects information describing the operating conditions and configuration of an electronic weapon system. The collected information may be the result of functional tests performed by configuration report function or by another circuit or processor. Collected information may be reported by the configuration report function or simply made available by the configuration report function to other functions (e.g., data communication function 124, processing circuits 130, memory 114). A configuration report function may detect whether an electronic weapon is configured for automatic or manual cartridge selections as discussed above. For example, configuration report function 142 of deployment unit 140 (172) includes a detector 143 that cooperates with indicator(s) or performs data communication with indicator(s) of deployment units (e.g., indicators of cartridges 105-106 and projectiles 150-160) and reports results to processing circuits 130. Processing circuits 130 may use these results to properly perform any warning, local stun, remote stun, and/or cartridge selection functions using suitable portions of one or more deployment units 104. Further, processing circuits 130 may interact with data communication function 124 and/or deployment unit control function 140 (172) to transfer collected information to other systems or to a memory of a deployment unit.

For example, a description of the configuration of launch device 102 (170) and the currently installed deployment unit(s) may be collected preferably with functional test results and stored in memory 114 just prior to or just following deployment of cartridge 105 (projectile 150). The same collected information may be associated with performance of a particular primary function (e.g., at a particular date, time, operator, and/or location), combined with audio, video, and other data, and transferred immediately or at a suitable time via data communication function 124 (e.g., at the end of the operator's shift).

A detector communicates with one or more indicators as discussed above. For example, detector 143 may include an independent sensor for detecting each indicator 112 of each cartridge of a deployment unit. In one implementation, detector 143 includes a circuit having a reed relay to sense the existence of a magnet or flux circuit of suitable polarity, permitivity, and/or strength at one or more positions proximate to cartridge 105 (projectile 150). The positions may define a code as discussed above that is detected by detector 143 and read by processing circuits 130 for governing operation of electronic weapon system 100 (180). A deployment unit may have multiple indicators (e.g., one set of indicators for each cartridge and/or projectile). A detector may have a corresponding plurality of sensors (e.g., reed relays).

A launch control function provides a signal sufficient to activate a propellant. For example, launch control function 144 (174) provides an electrical signal for operation of an electrically fired pyrotechnic primer. Interface 107 may be implemented with one conductor to each propellant 116 (e.g., a pin) and a return electrical path through the body of propellant 116, the body of cartridge 105 (projectile 150), and/or the body of launch device 102 (170).

A stimulus signal generator includes a circuit for generating a stimulus signal for passing a current through tissue of the target for pain compliance and/or for interfering with operation of skeletal muscles by the target. Any conventional stimulus signal may be used. For example, stimulus signal generator 146 in one implementation may deliver about 5 seconds of 19 pulses per second, each pulse transferring about 100 microcoulombs of charge through the tissue in about 100 microseconds. In an implementation, stimulus signal generator 146 provides stimulus programs as discussed below.

Stimulus signal generator 146 may have a common interface to all cartridges of a deployment unit 104 in parallel (e.g., simultaneous operation), or may have an individual independently operating interface to each cartridge 105, 106 (as shown). A current for a stimulus signal may further provide an arc (e.g., display) between two terminals of an unused cartridge and/or two terminals of an unused (e.g., empty) bay.

Stimulus signal generator 146 of a projectile (150-160) is positioned in a portion of the projectile that is launched toward a target. Power may be provided to a projectile via interface 107 prior to launch, but after launch, stimulus signal generator 146 includes a power source for providing one or more stimulus signals and any power required for operation of the projectile such as power for memory 114 and receiver 152.

A transmitter transmits information (e.g., data, number, address, message). A transmitter may use any conventional communication protocol. A transmitter may transmit information to a projectile prior to launch. A transmitter, preferably, transmits information to a projectile after launch and separation from interface 107. A transmitter may transmit information to one projectile of a set of projectiles. A transmitter may transmit information to all projectiles of a set (e.g., group) or all projectiles within range of the transmitter. A transmitter may transmit a projectile address (e.g., projectile identifier). An address may identify an intended recipient of transmitted information. A projectile may receive information transmitted for use by another projectile. A projectile may perform an operation of the projectile (e.g., stimulate, store) in accordance with receipt of the address of the projectile. An address may be unique to a projectile. An address may be unique to a set of projectiles. An address may be stored in memory 114 of a projectile.

A receiver receives transmitted information. A receiver may use any conventional communication protocol. A receiver may receive a transmitted address. A receiver may compare a received address to a stored address. A stored address may be the address of the projectile. A receiver may perform an operation of the projectile in accordance with the comparison.

Launch device 102, in configurations according to various aspects of the present invention, launches any one or more electrodes of a deployment unit 104 and provides the stimulus signal to any combination of electrodes for a remote stun function. Launch device 102 may further provide a stimulus signal to an unused cartridge and/or bay to provide an arc across a face of the cartridge and/or bay. For example, launch control function 144 may provide a unique signal to each of several interfaces 107, each cartridge of the deployment unit having one independently operated interface 107. Stimulus signal generator 146 may provide a unique signal to each of several sets of electrodes, each cartridge of the deployment unit having one independently operated set of electrodes. A cartridge may further include two or more terminals. In one implementation, launch device 102 provides a local stun function by coupling stimulus signal generator 146 to any one or more terminals located at a face of the launch device. According to various aspects of the present invention, such terminals cooperate with the wire stores of a cartridge to also activate electrodes of the cartridge for a remote stun function.

Launch device 170, in configurations according to various aspects of the present invention, may launch one or more projectiles of a deployment unit 190 and provide the stimulus signal via the terminals of one or more launched projectiles. Launch device may select one or more projectiles and initiate an operation of the selected projectiles by transmitting the address of the selected projectiles.

Operation of an electronic weapon system having such a launch device and deployment unit facilitates multiple function operation. For instance, a set of electrodes may first be deployed for a remote stun function and subsequently a set of terminals (e.g., of an unspent cartridge) may then be used for a local stun function. An operation of the weapon may further provide an arc between the terminals of unused cartridges and/or empty (e.g., unused) bays for providing a display (e.g., as an audible and/or visible warning). An operation of the weapon may further launch projectiles and initiate an operation of a launched projectile via transmission of information. When more than one set of electrodes (projectiles) have been deployed for remote stun functions, the remote stun functions may be performed on a selected target or on multiple targets (e.g., stimulus signals provided in rapid sequence among electrodes/projectiles or provided simultaneously to multiple electrodes/projectiles) as discussed herein. Providing a stun function on a selected target via wire-tethered electrodes may be accomplished by selecting a deployed cartridge whose electrodes are positioned proximate to the target and operating a control to provide an additional stimulus signal as discussed herein. Providing a stun function on a selected target via a deployed projectile may be accomplished by transmitting the address of the deployed projectile and possibly other information (e.g., command, query). Providing a stun function simultaneously to multiple targets may be accomplished by operating a stimulate control as discussed herein.

A cartridge includes one or more wire-tethered electrodes, a wire store for each electrode, and a propellant. The thin wire is sometimes referred to as a filament. Upon installation to launch device 102 of a deployment unit having a cartridge, launch device 102 determines the capabilities of at least one and preferably all cartridges of the deployment unit. Launch device 102 (170) may write information to be stored by the cartridge (projectile) (e.g., inter alia, identity of the launch device, identity of the operator, configuration of the launch device, GPS position of the launch device, date/time, primary function performed).

On operation of a control 120 of launch device 102, launch device 102 provides a stimulus signal for a local stun function. On operation of another control 120 of launch device 102 (170), launch device 102 (170) provides a launch signal to one or more cartridges (projectiles) of a deployment unit 104 (190) to be launched. Launch device 102 may further provide a stimulus signal to each cartridge to be used for a remote stun function. On operation of a control 120 of launch device 102, launch device 102 provides a stimulus signal to unused cartridges and/or empty bays to display an arc across the terminals of the unused cartridges and/or bays. Determination of which cartridge (projectile) to launch may be accomplished by launch device 102 (170) with reference to capabilities of the installed cartridges (projectiles) and/or operation of controls by an operator. According to various aspects of the present invention, the launch signal has a voltage substantially less than a voltage of the stimulus signal; and, the launch signal and stimulus signal may be provided simultaneously or independently according to controls 120 of launch device 102 (170) and/or according to a configuration of launch device 102 (170).

As discussed above, a cartridge includes any expendable package having one or more wire-tethered electrodes. As such, a magazine or a clip is a type of cartridge. According to various aspects of the present invention, cartridge 105 (106) of FIG. 1 includes an interface 107, an indicator 112, a memory 114, a propellant 116, and a contactor 118. In another implementation, indicator 112 is omitted and memory 114 performs functions of providing any or all of the indications discussed below with reference to indicator 112. In another implementation, memory 114 is omitted for decreasing the cost and complexity of the cartridge.

Interface 107 supports communication in any conventional manner and as discussed herein. Interface 107 may include mechanical and/or electrical structures for communication. Communication may include conducting electrical signals (e.g., connectors, spark gaps), supporting magnetic circuits, and passing optical signals. Interface 107 may be used to communicate with a projectile until after launch of the projectile.

An indicator includes any apparatus that provides information to a launch device. An indicator cooperates with a launch device for automatic communication of indicia conveying information from the indicator to the launch device. Information may be communicated in any conventional manner including sourcing a signal by the indicator or modulating by the indicator a signal sourced by the launch device. Information may be conveyed by any conventional property of the communicated signal. For example, indicator 112 may include a passive electrical, magnetic, or optical circuit or component to affect an electrical charge, current, electric field, magnetic field, magnetic flux, or radiation (e.g., light) sourced by launch device 102 (170). Presence (or absence) of the charge, current, field, flux, or radiation at a particular time or times may be used to convey information via interface 107. Relative position of the indicator with respect to detectors in launch device 102 (170) may convey information. In various implementations, the indicator may include one or more of any of the following: resistances, capacitances, inductances, magnets, magnetic shunts, resonant circuits, filters, optical fiber, reflective surfaces, and memory devices.

In one implementation, indicator 112 includes a conventional passive radio frequency identification tag circuit (e.g., having an antenna or operating as an antenna). In another implementation, indicator 112 includes a mirrored surface or lens that diverts light sourced by launch device 102 (170) to predetermined locations of detectors or sensitive areas in launch device 102. In another implementation, indicator 112 includes a magnet, the position and polarity thereof being detected by launch device 102 (170) (e.g., via one or more reed switches). In still another implementation, indicator 112 includes one or more portions of a magnetic circuit, the presence and/or relative position of which are detectable by the remainder of the magnetic circuit in launch device 102 (170). In another implementation, indicator 112 is coupled to launch device 102 (170) by a conventional connector (e.g., pin and socket). Indicator 112 may include an impedance through which a current provided by launch device 102 (170) passes. This latter approach is preferred for simplicity but may be less reliable in contaminated environments.

Indicator 112 in various embodiments includes any combination of the above communication technologies. Indicator 112 may communicate using analog and/or digital techniques. When more than one bit of information is to be conveyed, communication may be in serial, time multiplexed, frequency multiplexed, or communicated in parallel (e.g., multiple technologies or multiple channels of the same technology).

The information indicated by indicator 112 may be communicated in a coded manner (e.g., an analog value conveys a numerical code, a communicated value conveys an index into a table in the launch device that more fully describes the meaning of the code). The information may include a description of the deployment unit and/or cartridge 105, including for example, the quantity of uses (e.g., one, plural, quantity remaining) available from this cartridge (e.g., may correspond to the quantity of electrode pairs in the cartridge), a range of effective distance for each remote stun use, whether or not the cartridge is ready for a next remote stun use (e.g., indication of a fully spent cartridge), a range of effective distance for all or the next remote stun use, a manufacturer of the cartridge, a date of manufacture of the cartridge, a capability of the cartridge, an incapability of the cartridge, a cartridge model identifier, a serial number of the cartridge, a compatibility with a model of launch device, an installation orientation of the cartridge (e.g., where plural orientations may be used with different capabilities (e.g., effective distances) in each orientation), and/or any value(s) stored in memory 114 (e.g., stored at the manufacturer, stored by any launch device upon installation of the cartridge with that particular launch device).

A memory includes any analog or digital information storage device. For example, memory 114 may include any conventional nonvolatile semiconductor, magnetic, or optical memory. Memory 114 may include any information as discussed above and may further include any software to be performed by launch device 102 (170). Software may include a driver for this particular cartridge (projectile) to facilitate suitable (e.g., plug and play) operation of indicator 112, propellant 116, and/or contactor 118. Such functionality may include a stimulus signal particular to the use the cartridge is supplied to fulfill. For example, one launch device may be compatible with four types of cartridges: military, law enforcement, commercial security, and civilian personal defense, and apply a particular launch control signal or stimulus signal in accordance with software read from memory 114.

A propellant propels electrodes (or one or more projectiles) away from a launch device and toward a target. For example, propellant 116 may include a compressed gas container that is opened to drive electrodes (or a projectile having electrodes) via expanding gas escaping the container away from cartridge 105 (150) toward a target (not shown). Propellant 116 may in addition or alternatively include conventional pyrotechnic gas generation capability (e.g., gun powder, a smokeless pistol powder). Preferably, propellant 116 includes an electrically enabled pyrotechnic primer that operates at a relatively low voltage (e.g., less than about 1500 volts) compared to the stimulus signal delivered via contactor 118.

A contactor brings the stimulus signal into proximity or contact with tissue of the target (e.g., an animal or person). A contactor for a cartridge may include one or more wire-tethered electrodes for providing a remote stun and/or one or more terminals for providing a local stun or a display. The structures used by a projectile to establish an electrical coupling with a target may be referred to as contactors. Contactors may include terminals and/or electrodes. A projectile may separate upon contact with a target. The contactor from one portion of a separated projectile may be wire-tethered to a contactor of another portion of the projectile; however, the projectile and the contactors of the projectile are not wire-tethered to the launch device. Launching a projectile from a launch device physically separates at least a portion of the projectile completely from the launch device. A projectile may be assembled in a casing that remains in the launch device after launch. The casing may include terminals for arc display and/or for performing a local stun function.

Contactor 118 of a cartridge may perform both the local stun function, the remote stun function, and display of an arc as discussed above. For the remote stun function, contactor 118 includes electrodes that are propelled by propellant 116 away from cartridge 105. Contactor 118 provides electrical continuity between a stimulus signal generator 146 in launch device 102 and terminals for the local stun function. Contactor 118 also provides electrical continuity between the stimulus signal generator 146 in launch device 102 and the captive end of the wire tether for each electrode for the remote stun function. Contactor 118 receives stimulus control signals from interface 107 and may further include a stimulus signal generator (e.g., to supplement or replace a stimulus signal generator 146 of launch device 102). In a launched cartridge, contactor 118 receives a stimulus signal from stimulus signal generator 146 and provides the stimulus signal to the captive end of the wire tether for each electrode. The wire tethers transport the stimulus signal to the electrodes positioned in or near the target for delivery of the stimulus signal through the target. In the event that the electrodes and their respective wire tethers do not electrically couple to a target or to each other, contactor 118 cannot provide the stimulus signal via the electrodes, accordingly the stimulus signal arcs across the face of the cartridge from one contactor 118 to another contactor 118 of the same cartridge. Further, if the electrodes of a cartridge have not been launched (e.g., unused cartridge), the stimulus signal provided to contactor 118 may display an arc between contactors 118. If a cartridge has not been inserted into a bay, the stimulus signal provided to the bay may display an arc between the terminals of the bay.

Signals in interface 107 between launch device 102 and one or more deployment units (e.g., magazines or cartridges) may be identical, substantially similar, or analogous to communication between a launch device and a cartridge as discussed above with reference to FIG. 1.

Another embodiment of an electronic weapon system according to various aspects of the present invention operates with a magazine as discussed above. A magazine may include a package having multiple cartridges (projectiles) or a package having the functions of multiple cartridges (projectile) without the packaging of each cartridge (projectile) as a separable unit. Further, a magazine may provide some functions in common for all electrodes in the magazine (e.g., a common propulsion system, indicator, or memory function).

A magazine provides mechanical support and may further provide communication support for a plurality of cartridges. A cartridge (projectile) for use in a magazine may be identical in structure and function to cartridge 105 (150) discussed above except that indicator 112 and memory 114 are omitted. Indicator and memory functions discussed above may be accomplished by the magazine as to all cartridges (projectiles) that are part of the magazine. The indicator and/or memory of the magazine may store or convey information regarding multiple installations, cartridges (projectiles), and uses. Since such a magazine may be reloaded with cartridges (projectiles) and installed/removed/reinstalled on several launch devices, the date, time, description of cartridge (projectile), and description of launch device may be detected, indicated, stored, and/or recalled when change is detected or at a suitable time (e.g., recorded at time of use for a remote stun function). The quantity of uses may be recorded to facilitate periodic maintenance, warranty coverage, failure analysis, or replacement.

An electronic weapon system according to various aspects of the present invention may include independent electrical interfaces for launch control and stimulus signaling. The launch control interface to a single shot cartridge (projectile) may include one signal and ground. The launch control signal may be a relatively low voltage binary signal. The stimulus signal may be independently available for local stun functions without and with a cartridge installed in the launch device. The stimulus signal may be available to provide an arc prior to launch of the electrodes of a cartridge as discussed herein. The stimulus signal may be available for remote stun functions after the cartridge propellant has been activated.

A deployment unit may include several (e.g., 2 or more) sets of terminals for a warn function (e.g., arc) and/or local stun function as discussed above, and several (e.g., 2 or more) sets of electrodes, each set for a remote stun function as discussed above. A set may include two or more terminals or electrodes. Launch of electrodes may be individual (e.g., for effective placement when the target is too close for adequate separation of electrodes in flight) or as a set (e.g., in rapid succession or simultaneous). Electrodes launched in rapid succession may be accomplished by rapid successive operations of a trigger while the electronic weapon operates in an automatic configuration as discussed above.

In one implementation, a set of terminals and a set of electrodes are packaged as a cartridge, the deployment unit comprising several such cartridges. Before the electrodes of the cartridge are launched, a set of terminals of the electronic weapon (e.g., part of the launch device or part of a cartridge) may perform an arc (e.g., display, warning) function or a local stun function. In one implementation, after launch, only the remote stun function is performed from the spent cartridge; and other cartridges are available for the local stun or arc functions. Because the deployment unit includes more than one cartridge each with an independent interface or interfaces, the deployment unit facilitates multiple functions as discussed herein.

For instance, after a first cartridge of such a deployment unit has been deployed toward a first target, stimulus signal generator 146 may be operated to provide a first remote stun function to the first target and a warn function or a local stun function with terminals of unspent cartridges of the deployment unit. Electrodes from a second cartridge may be deployed to engage a second target to provide a second remote stun function through the second target. Subsequently, terminals of the remaining unspent cartridges of the deployment unit and/or the terminals of any empty bays may be used for another warn function or local stun function. The deployment unit may include terminals for the warn and/or local stun functions independent of cartridge configurations (e.g., none, some, or all installed; none, some, or all spent).

An electronic weapon system according to various aspects of the present invention provides an operator interface to facilitate use of the multiple functions of the system. An operator interface includes methods performed by a processor and methods performed by an operator. For example, processing circuits 130 of FIGS. 1A and 1B perform a state change method for operator interface 200, 250, and 260 of FIGS. 2A, 2B, and 2C respectively. In a state change method, only one state, as shown as an oval, is active at one time. To advance from one state to another, the criteria specified on a suitable arrow leaving the current state and arriving at the next state must be satisfied. In other words, when the criteria are satisfied, the state of the method is changed to the next state. Actions that are unique to a particular state may be performed when the method is currently in that particular state. Controls sensed by processing circuits 130 may include, inter alia, safety (on/off), trigger (set/release), stimulate (set/release), warn (set/release), select (set/release).

In one implementation, the stimulate and warn controls (or stimulate, warn, and select) are implemented together as one control. The terminals of a cartridge may provide a local stun function or a display. The terminals intended for a local stun function will display a visible arc with a loud popping sound (e.g., display) when no target is proximate to the terminals. The combined stimulate and warn control, if set, activates both warn and stimulate and if released deactivates both warn and stimulate.

In response to detecting application of power (e.g., battery power connected), operator interface as performed by processing circuits 130 begins in sleep state 202. At a minimum, only critical functions are performed in sleep state 202 to conserve battery power (e.g., maintaining time and date, maintaining contents of volatile memory, sensing particular controls). Critical functions may be performed without activating a processor of processing circuits 130. On sensing use of a control with safety off, operator interface 200 advances to the report state 204. Any of various information retained or accessible to processing circuits 130 may be reported to the operator in state 204. The operator may operate other conventional controls (e.g., hypertext links or menu items) to receive additional or different reports and/or specify new or changed configuration preferences. Reporting may continue in state 204 until completed or a change in the safety control is detected. Operator interface 200 advances back to sleep state 202 if the operator indicates reporting is accomplished or if a period of time lapses with no further changes of controls.

In response to detecting an active data communication signal of data communication function 124 or a change in the installation or removal of a deployment unit with which data communication (e.g., indicators or memories) is desired, operator interface 200 may leave sleep state 202 and advance to data transfer state 205. Transfer of data according to any suitable protocol may continue in state 205 until completed or a change in the safety control is detected. When new software is received, the configuration of the electronic weapon system may automatically be altered to install and/or run the received software. Operator interface 200 may be modified or replaced by operation of the received software. Assuming no such modification or replacement, operator interface 200 advances back to the sleep state if the data communication is abandoned or completed or if a period of time lapses with no further changes of controls.

In response to detecting the safety control in the "off" condition, operator interface 200 advances from state 202, 204, or 205 to armed state 206. Any primary function may be initiated from armed state 206. Capabilities of the electronic weapon system may be displayed sequentially or as requested by conventional operator controls (e.g., remaining battery capacity, ranges of cartridges available, number of projectiles present, selected cartridge and/or projectile for operation).

In response to detecting the warn control set, operator interface 200 advances from armed state 206 to warn state 207. Any suitable audible or visible warning circuit may be activated while in state 207. In one implementation, the audible warning issues commands directed to the target such as "Stop! Drop your weapons!, Put your hands over head!". As discussed above with respect to weapon 100, the stimulus signal generator may provide as a warning, loud, visible, arcing between terminals intended for a local stun function. Operator interface 200 advances back to the armed state when the warn control is released.

In response to detecting the trigger control set, operator interface 200 advances from the armed state to launch state 208, immediately launching one or more electrodes from one or more cartridges or one or more projectiles as specified by the configuration of the electronic weapon system prior to entering launch state 208. If the trigger control is promptly released, operator interface 200 advances from launch state 208 to run state 209. If not (e.g., a suitable period lapses and the trigger control is not released), then operator interface 200 advances from launch state 208 to stretch state 210.

Figure 2A:
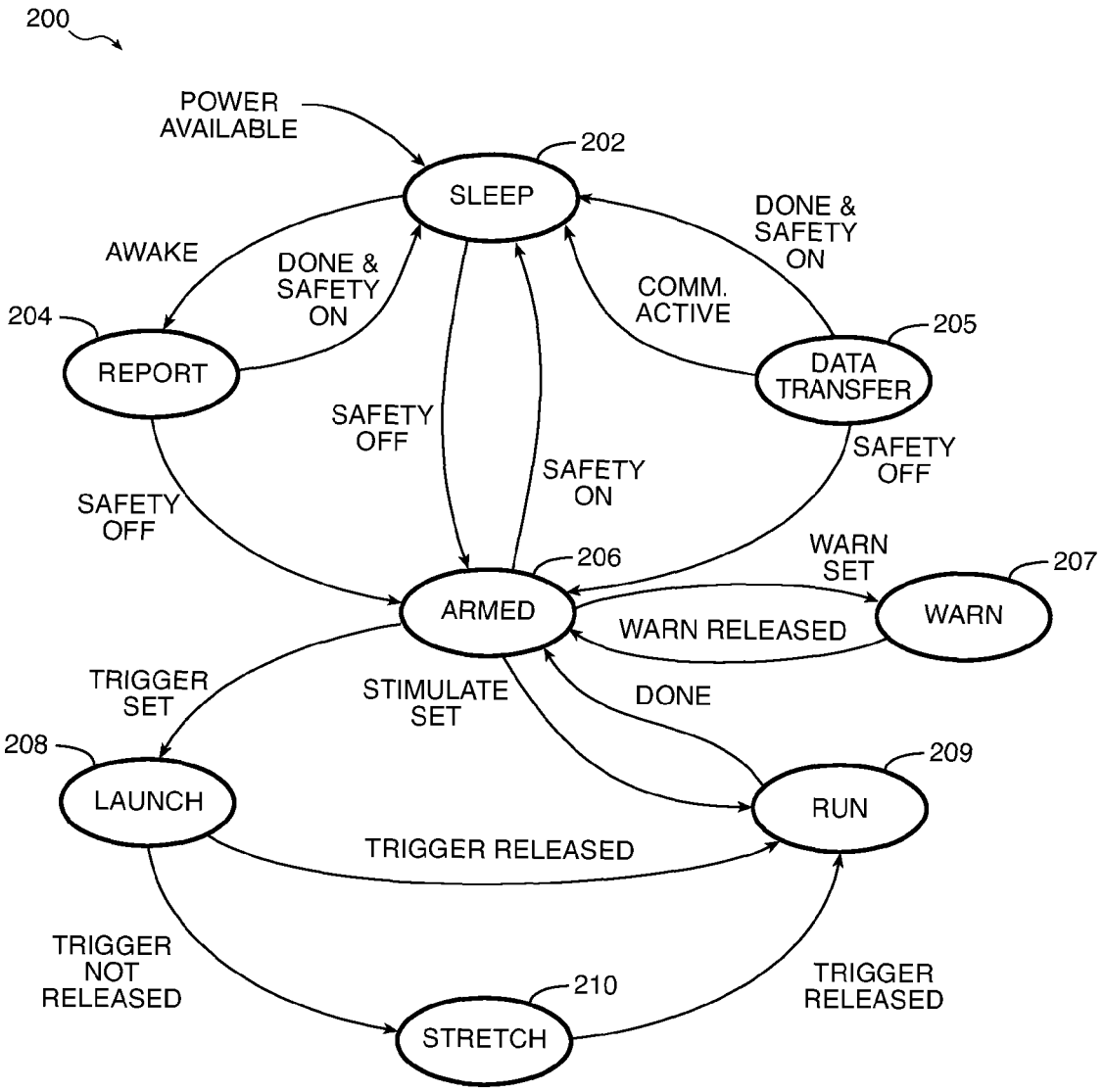
FIGS. 2A, 2B and 2C are state diagrams for various operator interfaces and processes each supporting an operator interface of the system of FIG. 1A.
Figure 2B:
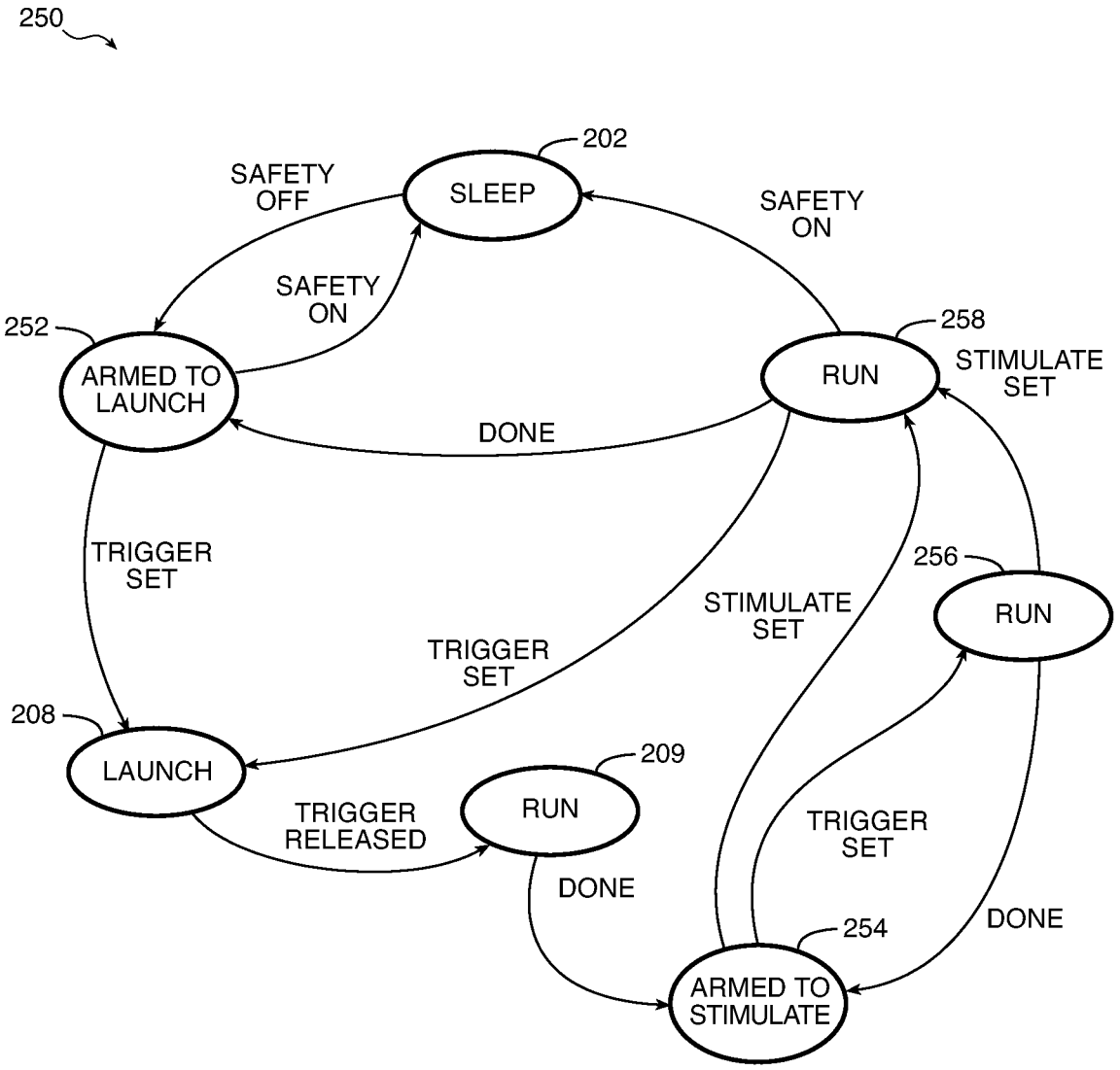

In another example, processing circuits 130 of FIG. 1 perform a state change method for operator interface 250 of FIG. 2B. Operator interface 250 includes sleep state 202, launch state 208, and run state 209 as discussed above. Interface 250 may further include report state 204, data transfer state 205, warn state 207, and stretch state 210 as discussed above (not shown). Uniquely, operator interface 250 includes armed to launch state 252, armed to stimulate state 254, run state 256 and run state 258. Run states 256 and 258 perform the functions discussed above with reference to run state 209 except that different state transitions are provided to and from run state 256 and 258 as discussed below.

In response to detecting the safety control in the "off" condition, operator interface 250 advances from sleep state 202 to armed to launch state 252. In response to detecting the trigger control set, operator interface 250 advances from armed to launch state 252 to launch state 208 whereupon electrodes and/or projectiles are launched as discussed herein. When the trigger control is released, operation continues in run state 209. In run state 209, signal generator 146 of launch device 102 provides a stimulus current for conducting through tissue of the target for a duration. When launching a projectile, run state 209 represents a delay of a duration for signal generator 146 of the launched projectile to provide the stimulus signal to a target. On completion of the run function of state 209, operator interface 250 advances to armed to stimulate state 254.

While in armed to stimulate state 254, operation of the stimulate control advances operation to run state 258. When in armed to stimulate state 254, operation of the trigger control advances user interface 250 to run state 256 to provide a subsequent run operation. In the case of a cartridge, signal generator 146 of launch device 102 provides a stimulus signal to the launched electrodes of the cartridge. In the case of a launched projectile, run state 256 transmits the address of the launched projectile via transmitter 176 to initiate delivery of another stimulus signal by signal generator 146 of the launched projectile. Upon completion of the operation of run state 256, operator interface 250 returns to armed to stimulate state 254. A subsequent launch can occur only after at least one operation of the stimulate control. This policy is accomplished by advance in response to operation of the stimulate control from either state 254 or state 256 to run state 258.

In run state 258, when the run operation of state 258 is completed, operator interface 250 advances to armed to launch state 252. Run state 258 operates similarly to run state 256 with respect to cartridges and projectiles.

In run state 258, when the trigger control is set, operator interface 250 advances to launch state 208.

If the safety control is sensed in the "on" condition, operator interface 250 advances to sleep state 202 from armed to launch state 252 or run state 258 (as shown); and from other states (not shown) including run state 256, run state 209, and armed to stimulate state 254.

A stimulus signal according to various aspects of the present invention is intended to assure compliance by the target with the intention of the operator of the electronic weapon system. A multiple function weapon, according to various aspects of the present invention provides the operator with the facility to assure compliance in different applications with different stimulus signals. Compliance may be as a consequence of pain felt by the target and/or interference with the target's use of its skeletal muscles.

As a first example, force against a target to gain compliance may be relatively greater than force against a target to maintain compliance. A stimulus signal suitable in this first example may include a strike stage followed by any number of hold stages. The energy expense of a hold stage may be less than that for a strike stage. As a second example, the initial force against a target may be suitably less than a subsequent force against the target who decides to resist compliance. A stimulus signal suitable in this second example may include any number of hold stages followed by one or more strike stages. Strike stages and hold stages of varying energy expenditure may be available to the operator for a variety of applications. For example, the duration of a stage may be subject to adjustment by the operator during the stage.

As discussed above, the duration of a stage may be extended in stretch state 210 from an initial duration up to a maximum duration if the trigger control is not released. The initial duration may be a factory setting, a user-configurable setting, or a recent stretched duration. The display may report the remaining duration including the extension and count up as the trigger control is held without release. An operator desiring to extend a stage for example 25 seconds, may watch the display advance up from perhaps 5 seconds to 25 seconds and then release the trigger control. Any strike stage or hold stage may be extended. As shown in FIG. 2, the first stage performed after launch is extended by operation of the trigger control.

Information transmitted to a launched projectile by a launch device may instruct the projectile as to the number and/or sequence of strike stages and/or hold stages to delivery to a target. Stretch state 210, in the case of a weapon that launches projectiles, may transmit information to one or more projectiles to instruct the projectile to increase duration of a stimulus signal.

In other implementations according to various aspects of the present invention, a control different from the trigger control may be used, a type of stage to be extended may be specified by the operator, and/or an identified stage (current, or future) can be identified for extension. For example, with reconfiguration by the operator, the nth stage (e.g., the first, second, third) regardless of type may be selected for extension. In another example, all stages of a particular type are extended (e.g., all hold stages after an initial strike stage). To allow the target more effective breathing, an electronic weapon system according to various aspects of the present invention may introduce (e.g., regardless of operator controls) a rest stage that does not include stimulus sufficient to interfere with the target's breathing). In suitable applications, the extension may be negative so as to effect a decrease in the duration of an identified or predetermined stage of the stimulus signal.

In response to detecting release of the trigger control, operator interface 200 advances from stretch state 210 or launch state 208 to run state 209, as discussed above. With regard to launch device 102, in run state 209, the duration of the strike and hold stages are metered and the stimulus signal generator is controlled so that desired durations of strike, hold, and rest stages are accomplished. When accomplished, operator interface 200 advances from run state 209 to armed state 206. Run state 209 may be aborted and operator interface 200 may advance (not shown) from run state to report state 204 in response to detecting safety control in the "on" condition.

In response to the stimulate control set, operator interface 200 may advance from armed state 206 to run state 209. Consequently, the predetermined duration (as opposed to a stretched duration) of strike, hold, and rest stages is metered in run state 209 as discussed above. Run state 209 may further transmit the address of the one or more projectiles that should provide an additional stimulus signal.

A launch device, according to various aspects of the present invention, may support an operator configurable set of multiple functions selected from an open set of functions. The open set of functions may include programmable control of a stimulus signal generator. Operator configuration of selected functions may include field installation of a set of modules that communicate with a processor of the launch device. Operator selection may be based on meeting an expected mix of applications for an electronic weapon system as discussed above. When multiple units of electronic weapon systems are involved in a tactical operation, a mix of electronic weapon system configurations may be used to more effectively accomplish the tactical operation. To accomplish some or all of these functional capabilities, a launch device, according to various aspects of the present invention, includes an interface that accepts members of the open set of functions. The interface supports the transfer of software from the member to the processing circuits 130 for supporting and integrating the member function into the operation of the electronic weapon system.

Figure 2C:
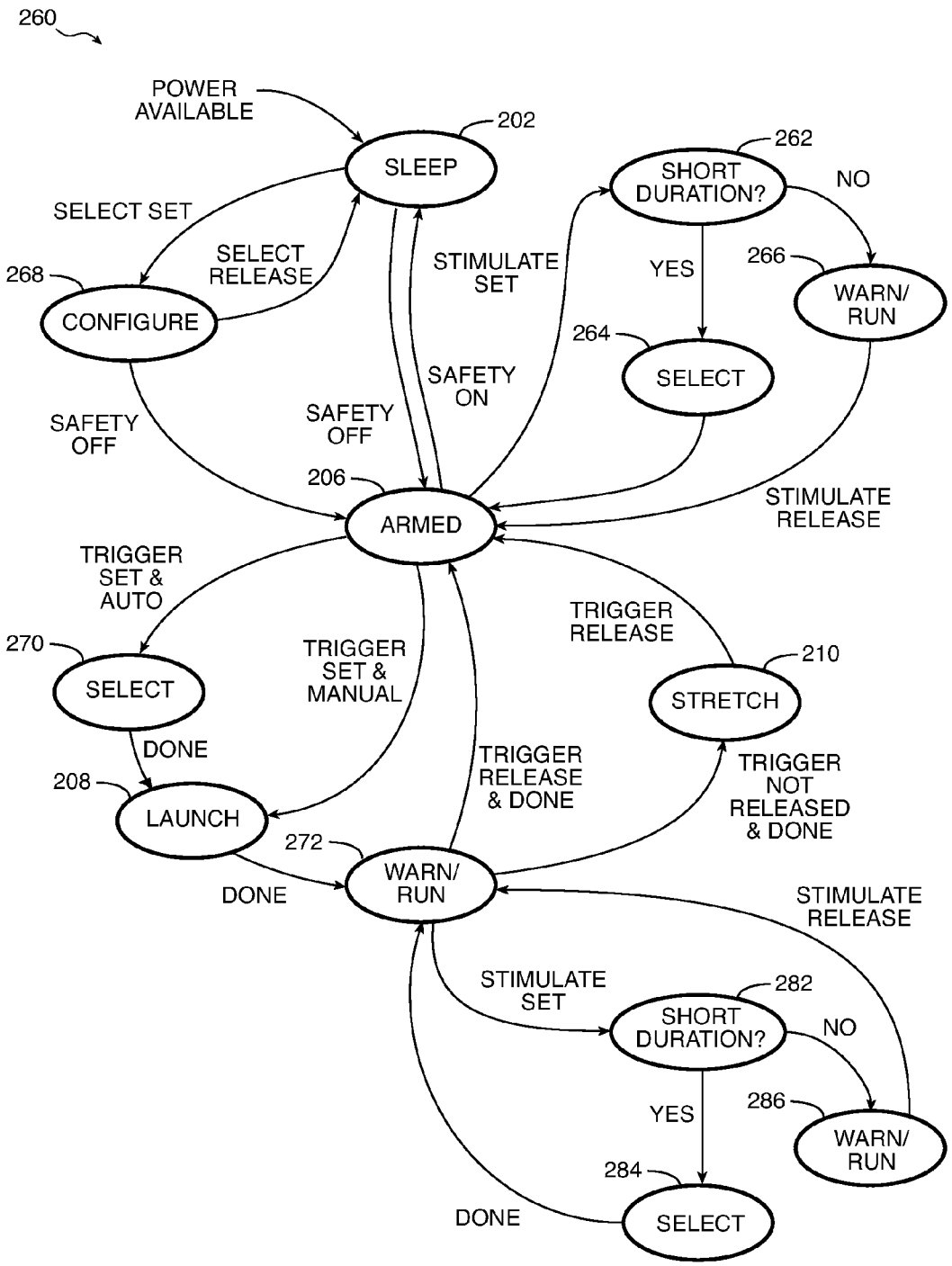

In another example, processing circuits 130 of FIG. 1 perform a state change method for operator interface 260 of FIG. 2C. Operator interface 260 includes sleep state 202, armed state 205, launch state 208, and stretch state 210 as discussed above. Interface 250 may further include configure state 268, short duration state 262 (282), warn/run state 266 (286, 272), and cartridge select state 264 (284, 270).

Launch state 208, as discussed above, launches electrodes and/or projectiles from one or more presently selected unused cartridges and/or projectiles. In the event that a presently selected cartridge is a used cartridge, launch state 208 may provide a launch signal to the used cartridge, but no additional electrodes will launch. In the event that the presently selected projectile has already been launched, launch state 209 may provide a launch signal to the bay that held the projectile prior to launch, but no additional projectile will launch if an unused projectile has not been placed in the bay. Upon completion of the function performed by launch state 208, whether or not electrodes or a projectile are launched, operator interface 260 advances to warn/run state 272.

While in sleep state 202, an operation of a select control advances operator interface 260 to configure state 268. Configure state 268 permits a user to configure operation of the electronic weapon and/or deployment unit. Any function and/or configuration discussed herein may be configured in configuration state 268. Configuring an electronic weapon may include selecting whether the weapon operates in an automatic or manual configuration. In an automatic configuration, the processing circuit 130 selects a next cartridge (projectile) as the presently selected cartridge (projectile). Selection may include receiving user provided information via a range priority control for cartridges as discussed above. Selection may be response to user operation of a control (e.g., trigger). In an automatic configuration, a weapon may select (e.g., advance) to a next unused cartridge (projectile). Selection may skip over (e.g., bypass, not select) used and/or inoperative cartridges (projectiles) to enable a user to sequentially launch wire-tethered electrodes from all unused cartridges or unlaunched projectiles to provide rapid delivery of stimulus to one or more targets. After all cartridges have been selected and the electrodes of all cartridges launched, the last fired cartridge remains the presently selected cartridge.

In a manual configuration with respect to weapon 100, a user operates a control (e.g., select, stimulate, combined controls) to select a next cartridge as the presently selected cartridge. A user may operate another control (e.g., trigger) to initiate an operation of a function of the presently selected cartridge (e.g., launch, arc, additional stimulus). In the manual mode, after performing an operation of the presently selected cartridge, the weapon does not select a next cartridge (e.g., does not advance). Selection of a next cartridge is performed by a user via operation of a control. Unlike selection as performed in an automatic configuration, a user may select either a used or an unused cartridge. Selection of an unused cartridge enables launch of the wire-tethered electrodes of the cartridge. Selection of a used cartridge, or retaining (e.g., not advancing) a used cartridge as the presently selected cartridge, permits the user to provide additional stimulus via the launched electrodes of the presently selected cartridge responsive to operation of another control (e.g., trigger).

In a manual configuration with respect to weapon 180, a user operates a control (e.g., select, stimulate, combined controls) to select a next projectile as the presently selected projectile. A user may operate another control (e.g., trigger) to initiate an operation of a function of the presently selected projectile (e.g., additional stimulus). In the event that the presently selected projectile is a projectile that has already launched, launch device 170 transmits information to the presently selected projectile to instruct the projectile to perform an operation. Launch device 170 may transmit the address of the projectile so that only the presently selected projectile performs the operation. In the manual mode, after either launching the presently selected projectile or transmitting information to a previously launched projectile, weapon 180 does not select a next projectile (e.g., does not advance). Selection of a next projectile is performed by a user via operation of a control. Unlike selection as performed in an automatic configuration, a user may select either launched (e.g., used) or an un-launched (e.g., unused) projectile. Selection of an unused projectile enables launch of the projectile. Selection of a used projectile, or retaining (e.g., not advancing) a used projectile as the presently selected projectile, permits the user to provide additional stimulus via the presently selected projectile responsive to operation of another control (e.g., trigger).

While in configure state 268 an operation of a select control advances operator interface 260 to sleep state 202. An operation of a safety control advances operator interface 260 to armed state 206.

While in armed state 206, an operation of the trigger control advances operator interface 260 to cartridge select state 270 and launch state 208 while the weapon is configured in the automatic or manual configurations respectively. Operation of stimulus control advances operator interface 260 to short duration state 262.

Select state 264 (284, 270) selects a next cartridge and/or projectile to operate as a presently selected cartridge (projectile). Operator interface 260 enters select state 270 while in the automatic configuration. In an implementation, select state 270 selects a next cartridge (projectile) only from the unused cartridges (projectiles) of a set of cartridges (projectiles). Selection of only unused cartridges (projectiles) may provide rapid launch of electrodes from cartridges or projectiles against one or more targets as discussed above. Select 270 may further skip over cartridges (projectiles) that are detected as being defective.

Operator interface 260 enters select state 264 (284) while in the manual configuration. Accordingly, a user, via manual operation of a control, may select a used or an unused cartridge and/or projectile as the presently selected cartridge (projectile). Selection may advance sequentially, whether in forward, reverse, or out-of-turn order, through the cartridges (projectiles) of a set of cartridges (projectiles). Selection may advance from a last cartridge (projectile) of a set to the first cartridge (projectile) of the set (e.g., wrap around). An electronic weapon may provide a display that indicates the presently selected cartridge (projectile). After the function of select state 264 (284, 270) is performed, operator interface 260 advances to armed state 206 or warn/run state 272 respectively.

Short duration state 262 (282) performs a function in accordance with a duration of operation of a control by a user. Short duration state 262 (282) determines whether the operation of a control is of a shorter (e.g., <200 ms) duration or a longer (e.g., >=200 ms) duration. In operator interface 260, an operation of stimulate control 508 may select a cartridge (projectile, provide a stimulus signal, and/or display an arc. A duration of holding (e.g., pressing, setting, operating) stimulate control 508 may determine the function performed. The configuration of the weapon, whether automatic or manual, may further determine the function performed by an operation of stimulate control 508.

For example, while in armed state 206 or warn/run state 272, an operation of stimulate control 508 transfers control to short duration state 262 (282). An operation of stimulate control 508 for a shorter duration advances operator interface 260 to select state 264 (284) respectively. An operation of stimulate control 508 for a longer duration advances control, whether in automatic or manual configuration, to warn/run state 266 (286) respectively. The functions of warn/run state 266 (286) are performed as long as stimulate control 508 is held in a set condition, thus operator interface 260 advances from short duration state 262 (282) to warn/run state 266 (286) upon detecting that stimulate control 508 has been held for a longer duration.

Warn/run state 266 (286, 272) may perform some or all of the functions of run state 209 (256, 258) and/or warn state 207 as discussed above. An electronic weapon in warn/run state 272 may provide a stimulus signal to a presently selected cartridge and/or transmit instructions for a previously launched projectile to provide a stimulus signal. Warn/run state 272 provides a stimulus signal to the presently selected cartridge for a duration (e.g., 5 seconds). Warn/run state 272 transmits an instruction to a launched projectile to provide a stimulus signal to the presently selected projectile for a duration. In the manual configuration, operator interface 260 may advance through states 282 and 284 to select a different cartridge (projectile) as a presently selected cartridge (projectile) while the previously selected cartridge (projectile) still provides a stimulus signal for the remainder of the duration. Warn/run state 272 may provide a stimulus signal to one or more cartridges or projectiles that have been selected manually. In the event that an unused cartridge is selected, the stimulus signal provided to the presently selected cartridge displays an arc across the face of the cartridge as discussed above. After completing (e.g., lapse of time) the function of warn/run state 272, operator interface advances to armed state 206 if the trigger has been released or to stretch state 210 if the trigger has not been released. The duration of the performance of the function performed by warn/run state 272 may be extended by stretch state 210 as discussed above.

While in warn/run state 266 (286), all bays and all cartridges of a set receive a stimulus signal and all launched projectiles are instructed to provide another stimulus signal. As discussed above, provision of a stimulus signal to a used cartridge provides the stimulus signal to the launched electrodes. Provision of a stimulus signal to an unused cartridge displays an arc between terminals of the cartridge. Provision of a stimulus signal to an empty bay provides an arc between terminals of the bay. Because all bays and all cartridges of a set receive a stimulus signal, the stimulus signal may be provided through one or more targets and/or one or more cartridges may display an arc and/or one or more bays may display an arc. Furthermore, because all launched projectiles are instructed to provide an additional stimulus signal while in warn/run state 266 (286), the stimulus signal may be provided through one or more targets via the launched projectiles. Warn/run state 266 (286) may be used to provide additional stimulus signals to all targets as opposed to selecting a single target to provide an additional stimulus signal. Operator interface 260 remains in warn/run state 266 (286) until stimulate control 508 is released. Upon release of stimulate control 508, operator interface 260 advances from warn/run state 266 and warn/run state 286 to armed state 206 and warn/run state 272 respectively.

Figure 3:
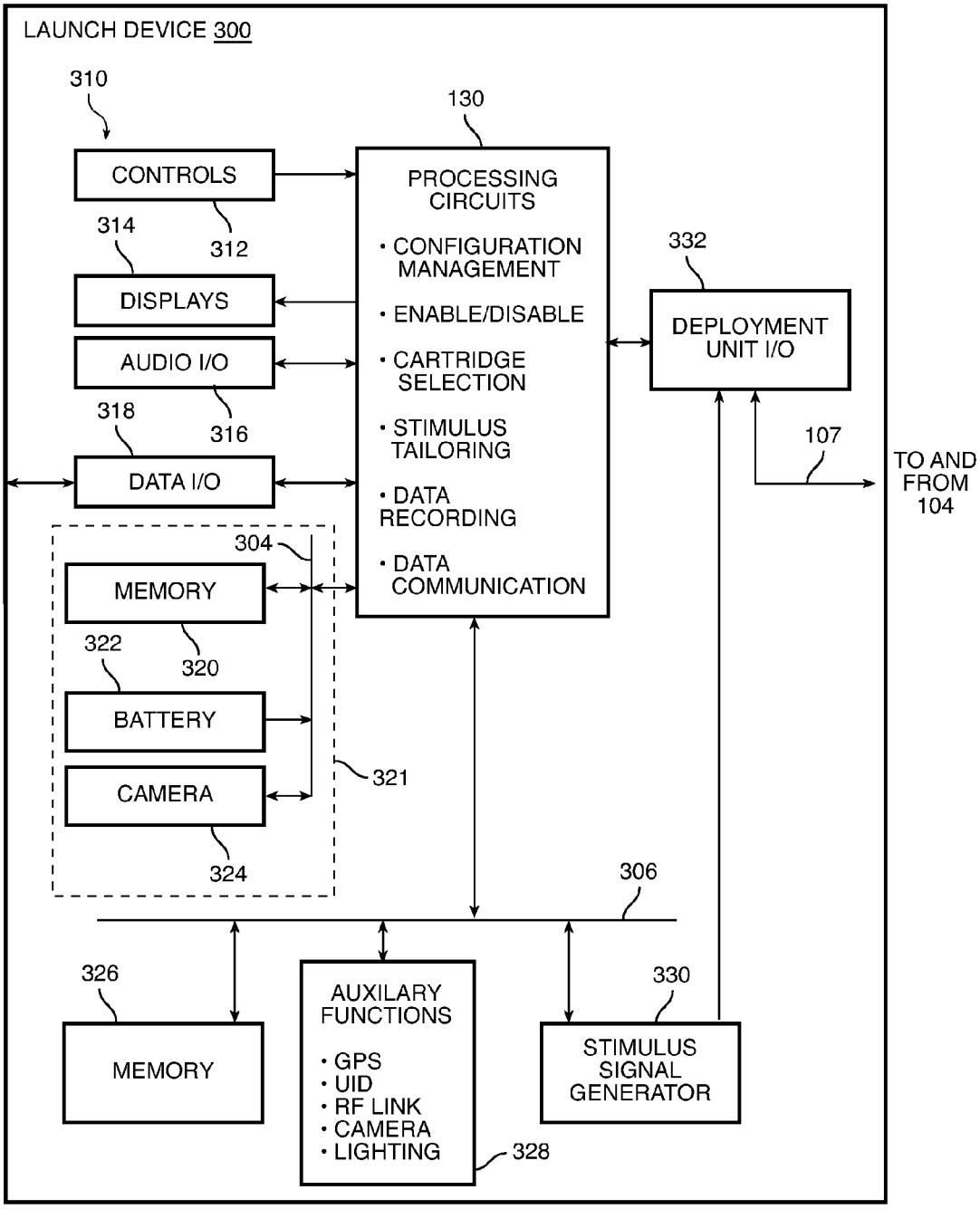
FIG. 3 is a functional block diagram of a launch device in another implementation according to various aspects of the present invention that may be used in the system of FIGS. 1A and 1B.

In an implementation, launch device 300 of FIG. 3 may perform all of the functions discussed above with reference to launch device 102 and include structures that further facilitate multiple function electronic weapon systems. Launch device 300 includes built-in functions 310 coupled to processing circuits 130, tactical functions bus 306 coupled to processing circuits 130, deployment unit I/O function 332, and processing circuits 130. Tactical functions bus 306 provides power and communication signals among processing circuits 130, an open set of auxiliary functions 328, memory 326, and stimulus signal generator 330. Because processing circuits 130 and stimulus signal generator 330 are coupled to bus 306, auxiliary functions coupled to bus 306 may have access to both processing circuits 130 and stimulus signal generator 330 for purposes including obtaining status, reporting status, and effecting adjustment to a configuration, and effecting control. Launch device 300 constitutes a platform for application specific electronic weaponry and multiple application electronic weaponry. Plural units having the functions of launch device 300 (and possibly unique sets of auxiliary functions) may be used cooperatively and also may automatically cooperate for accomplishing a tactical objective.

Built-in functions 310 includes controls 312, displays 314, audio I/O 316, data I/O 318, and a rechargeable subassembly 321. The components of built-in functions 310 may communicate with processing circuits 130 using conventional circuits and software. Controls 312 and displays 314 implement operator interface 200 (120, 122) discussed above. In various other implementations according to the present invention, built-in functions 310 may include any or all of the auxiliary functions discussed with reference to auxiliary functions 328 and/or any functions of a rechargeable subassembly discussed with reference to rechargeable subassembly 321.

Audio I/O 316 includes a conventional microphone and conventional speaker with suitable digital conversion for use by processing circuits 130. Audio output may be directed to the operator of launch device 300 (e.g., at volume levels similar to cellular telephone), to other operators (e.g., tactical and reinforcement personnel) (e.g., at volume levels similar to police radios), or to targets and potential targets (e.g., at volume levels similar to public address systems). The speaker may be omitted in an implementation where recording is desired without audio output. Audio input may be transmitted (e.g., live streaming) and/or stored (e.g., for later download, transmission, or analysis).

Data I/O 318 implements data communication function 124 discussed above. Data I/O 318 may include buffer memory for queuing messages to be sent when a data communication link becomes available and for retaining received information that awaits access by processing circuits 130. Data I/O 318 may monitor the availability of potential communication links and automatically receive information and/or transmit queued messages.

Rechargeable subassembly 321 includes memory 320, battery 322, camera 324, each of which is coupled to bus 304. Components of rechargeable subassembly 321 may communicate on bus 304 with processing circuits 130. Since rechargeable assembly 321 may be frequently removed and replaced for recharging, bus 304 makes the interconnection between rechargeable subassembly 321 and processing circuits 130 mechanically and electrically reliable. Bus 304 includes communication signals and power signals. Suitable transmitter and receiver circuits may be used in launch device 300 and in rechargeable subassembly 321 when bus 304 coupling includes wireless coupling. In one implementation, power signals are coupled using magnetic circuits (e.g., inductive coupling) for the wireless transfer of energy into launch device 300. When rechargeable subassembly 321 is removed from launch device 300 and placed in a charging cradle (not shown), inductive coupling supports wireless transfer of energy from the cradle into battery 322 to recharge battery 322. Communication signals may be coupled from bus 304 to either launch device 300 or the cradle by magnetic, electrostatic, radio, and/or optical circuitry. For operation of launch device 300 and rechargeable subassembly 321 in harsh environments with risk of dust and liquid contamination, magnetic coupling of power signals and radio communication of communication signals is preferred.

Deployment unit I/O 332 cooperates with one or more deployment units that each include a magazine having an indicator and/or memory, as discussed above, and/or include a plurality of cartridges, each having an indicator and/or memory, as discussed above. Deployment unit I/O 332 implements the configuration report and launch control functions of deployment unit control 140 discussed above. Deployment unit I/O 332 includes circuits and may include software or firmware for periodically determining the configuration of installed deployment units, and reporting or making accessible to processing circuits 130 the up to date results of those determinations.

Auxiliary functions include any function for improving the effectiveness of the launch device in any tactical operation. For example, launch device 300 includes a bus 306 and several ports served by the bus, so that any auxiliary function, packaged as a module, may be installed in one of the several ports. A set of operator preferred auxiliary modules may be installed to cooperate with launch device 300 and with each other as discussed above. Auxiliary functions form an open set so that new modules may be designed to be accepted at one or more of the ports to implement additional auxiliary functions in the future.

In one implementation, launch device 300 provides one port to bus 306. One or more auxiliary functions are implemented in each of a set of operator replaceable modules. Any one module may attach to the port. Each module may provide a subsequent port for accepting another module of the set.

A positioning system function is an auxiliary function for determining a physical location of the module and consequently the launch device. For example, a conventional global positioning system (GPS) receiver may be incorporated into a positioning system module (328) with suitable port interface circuitry and software. Cooperation between the processor and the GPS module (328) may facilitate including physical locations at particular dates and times (e.g., when a primary function is performed) in association with data stored or communicated by processing circuits 130. Cooperation of a GPS module (328), processing circuits 130, and stimulus signal generator 330 may facilitate tailoring of a stimulus signal program in accordance with a physical location (e.g., to be within the regulations of a jurisdiction, to prevent use of an arc where fire hazard exists in a portion of a facility). Cooperation of a GPS module (328), processing circuits 130, and a data I/O function 318 or RF link auxiliary module (328) may facilitate use of a particular communication channel, technology, or transmitting signal power suitable to the physical location.

A user identification function is an auxiliary function for determining information tending to identify the operator of the launch device. For example, a conventional personnel identification technology may be incorporated into a user identification (UID) module (328) with suitable port interface circuitry and software. Personnel identification technologies include thumbprint, retina scan, voice recognition, and other biological sensor technologies. In other implementations conventional bar code, badge, and radio frequency identification (RFID) tag technologies may be used. The RFID tag may be incorporated into jewelry (e.g., a ring, bracelet, necklace, watch), clothing (e.g., a badge, patch, button, belt buckle, belt, glove, helmet), or another personal electronic device (e.g., a cellular telephone, police radio, emergency alerting device). The tag may be passive or include a transmitter or transponder. In one implementation, data I/O 318 further includes a transmitter and/or a receiver used to detect indicia of operator identification.

Cooperation of a UID module (328), processing circuits 130, and stimulus signal generator 330 may include tailoring a stimulus program in accordance with the user identification (e.g., training, consumer, security, law enforcement, and military applications may differ). In other words, the same launch device may be issued to different users and each automatically produces a suitable stimulus program.

Cooperation of a UID module (328) and stimulus signal generator functions may effect disabling of stimulus signal generation in the absence of an authorized UID. Authorized UIDs may be stored for comparison to a detected UID (e.g., in memory 320 and/or 326). Detection of attempted operation in the absence of a an authorized UID may initiate storing and/or transmitting (e.g., via RF link) audio, video, and/or data (e.g., time, date, position by GPS). Storage and/or transmission may assist authorities in tracing handling of the launch device by unauthorized persons.

Memory that is part of a UID module (328) may be used (or memory 326 or 320) to list registered user identification. Registration may be accomplished via an operator interface or by software loaded from memory 320. Registration may be individual or generic (e.g., all members of a police force are permitted to used launch devices issued to any other member of the police force). If an attempt to use launch device 300 is made by an unregistered user (e.g., no user identification is detected by the UID module (328) or a mismatch occurs), launch device 300 may advise the operator and block some or all functions (e.g., block all primary functions but enable data communication via an RF link or otherwise to authorities to report the location and user identification if any).

An RF link function is an auxiliary function for communication between launch devices, for communication with conventional RF accessible information systems, or for wireless data communication in cooperation with data I/O 318 as discussed above. For example, a conventional radio transmitter and receiver may be incorporated into an auxiliary module (328) with suitable port interface circuitry and software. An RF link module (328) may facilitate exchange of information between the launch device and any server or user of the Internet.

Data that may be sent from launch device 300 may include broadcasts or responses to interrogation. Data may include user identification, launch device identification, time and date, operation of a control (e.g., set and/or release of safety, trigger, stimulate, range priority), control of an auxiliary function (e.g., camera on/off, laser sight on/off), and/or device status (e.g., battery capacity, deployment unit remaining capability). Data communication by RF link may serve to synchronize time and date in launch device 300 with a master authority for time and date (e.g., a station headquarters, a tactical lead launch device, a remote tactical headquarters, a cellular telephone network, a radio based authority (GPS, WWV)). A communication via RF link may serve to enable and/or disable use of any function of launch device 300.

Cooperation of one or more RF links, processing circuits 130, and audio I/O function 316 may facilitate launch device 300 performing all conventional radiotelephone, network terminal, and network node functions (e.g., radio dispatch, secure voice communication, public cellular telephone, emergency communication network terminal or node, ad hoc network terminal or node among launch devices, computers, and hubs such as cell phone towers) especially if the RF link capability has multiple directional antennas used in accordance with conventional ad hoc network technologies.

An RF link may port the audio I/O to and from a remote headset or helmet having a microphone and/or speaker functionally substituting for the microphone and speaker of audio I/O function 316 to facilitate higher quality audio input for recording by launch device 300 and/or more understandable audio output from launch device 300.

A camera function is an auxiliary function for video motion picture recording. Video recording may be associated with use of a primary function. For example, a conventional video camera may be incorporated into a camera module (328) with suitable port interface circuitry and software. Cooperation of a camera module (328), processing circuits 130 and memory 320 or 326 may facilitate the same functions that would have been available from camera 324 when rechargeable subassembly 321 is implemented without camera 324. Camera 324 may operate simultaneously with a camera module (328), for example, for different field or angle of view, and/or different sensitivity (e.g., infrared, visible, polarization, filtered). A camera function (324, 328) may cooperate with an RF link function (328) to effect broadcast of live or recorded video in any conventional format (e.g., file transfer, live streaming). Broadcast may facilitate use by another launch device (e.g., for live viewing). Broadcast to a tactical station may facilitate live viewing, analysis, and/or archive. Broadcast or download to an archive station may facilitate forming or maintaining records of use of force.

A use of force recorder (or transmitter), according to various aspects of the present invention, may omit deployment unit (332) and stimulus signal generator (330) functions. For example, a use of force recorder (or transmitter) may include audio and/or video recording and downloading (or transmitting) capability. In another implementation, a use of force recorder (transmitter) may include audio I/O (316), processing circuits (130), camera (324, 328), RF link (328), illumination (328), and range finder functions as discussed herein.

A lighting function is an auxiliary function for illuminating the target or an area desired by the operator (e.g., a map reading light). Any conventional illuminator may be incorporated into a lighting module (328) with suitable port interface circuitry and software. Lighting as directed by processing circuits 130 may facilitate aiming the electronic weapon system toward the target, disorienting the target with bright flashes of light, emergency light signaling, and/or illumination as needed for improved use of a camera 324 or a camera module (328).

Other auxiliary functions (not shown) include a range finder function and a target identification function. A range finder estimates the distance from a particular cartridge (or the launch unit) to a particular target. Processing circuits 130 may provide via bus 306 a description of a particular cartridge. The particular cartridge may be as identified by the user, identified in accordance with an application and/or tactical operation, or identified according to a result of the range finding function (e.g., recursively). If all cartridges are in one location, identification of a particular cartridge may be omitted. A range finding function may include any conventional distance sensing and measuring technology. For example, pulsed energy (e.g., audio, radio, or laser light) may be reflected by the target and distance determined from a propagation delay from the transmitted pulse output signal to the received reflected input signals. The target may be identified by processing circuits 130 (e.g., using camera and/or lighting functions) or by the range finding function (e.g., a conventional laser spot on the target).

Processing circuits may include conventional stored program machines implemented with conventional circuits, firmware, and operating system software. For example, processing circuits 130 may be implemented with a single microprocessor or microcontroller. Processing circuits 130 perform methods for configuration management, enable/disable primary functions and/or auxiliary functions, cartridge selection for primary functions, stimulus tailoring, data recording, and data communication.

A method for configuration management, performed by processing circuits 130 according to various aspects of the present invention, may include in any practical order, one or more of the following operations: (a) determining a functional description of operational stimulus signal generators 330; (b) determining a functional description of operational auxiliary functions 328; (c) determining a functional description of operational deployment units; (d) determining whether software for supporting operational signal generators, operational auxiliary functions, and/or operational deployment units is available and up to date with reference to memory 320, 326, memory (not shown) of processing circuits 130, memory of a deployment unit, and buffered or available data communication via data I/O 318; (e) updating software in program memory accessible to processing circuits 130 as needed; (f) performing nondestructive functional tests on any or all functions of launch device 300; (g) storing functional description information in any of memories 320, 326, and memory of a deployment unit; and (h) communicating and/or storing functional description information in any or all of memory 320, 326, memory of a deployment unit, and buffered or available data communication via data I/O 318.

A method for enable/disable of primary and/or auxiliary functions, performed by processing circuits 130 according to various aspects of the present invention, may include in any practical order, one or more of the following operations: (a) determining available battery capacity (e.g., to reduce the possibility of a brown out during an enabled primary function); (b) determining environmental factors (e.g., temperature, presence of moisture, humidity) to determine whether the environment is suitable for a primary function or auxiliary function to be performed (or adjustments for the intended function may be made); (c) advising the operator of enabled functions and functions available to be enabled as directed by the operator; (d) advising the operator of disabled functions and functions to disable as directed by the operator; and (e) performing a method for an operator interface to determine whether a operator specified function is requested to be performed.

A method for cartridge selection, performed by processing circuits 130 according to various aspects of the present invention, may include in any practical order, one or more of the following operations: (a) determining a description of all operational cartridges; (b) determining an operator preference for a remote stun function capability (e.g., a range of effective distance, a selection of electrode type suitable to the clothing of the target); (c) advising the operator when the operator's preference cannot be met (e.g., operator prefers long effective distance, but all operational cartridges have short effective distance capability; (d) determining a firing order for operational cartridges in accordance with descriptions of operational cartridges, the operator's preferences, and a firing order policy; (e) cooperating with a deployment unit to activate a particular operational cartridge. A firing order policy may be implemented in program logic. A firing order policy may be relied on in the absence of suitable operator preferences or to resolve ambiguity in exceptional cases (e.g., operator prefers medium effective distance however only short and long distance cartridges are operational, therefore, the long effective distance cartridge will be used). An operator preference may be indicated in any conventional manner and/or by a "range" preference control as discussed herein.

Figure 4A:
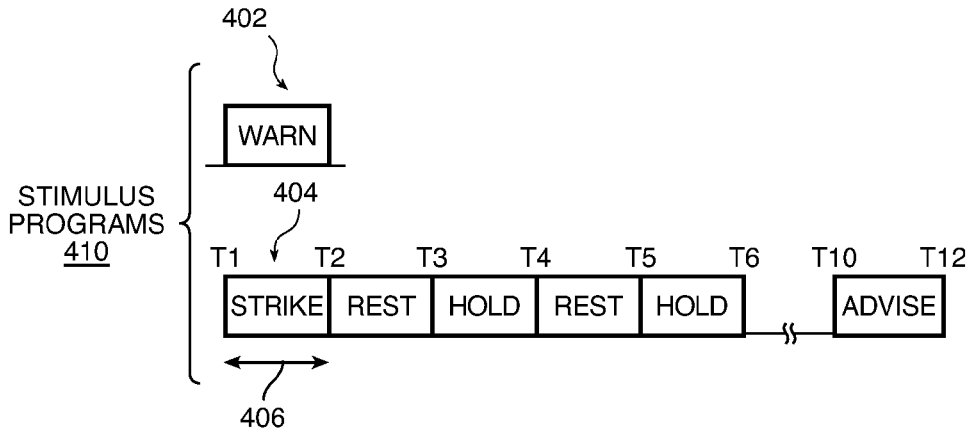
FIGS. 4A through 4D are signal definition diagrams for signals at terminals or electrodes of the system of FIGS. 1A and 1B.
Figure 4B:
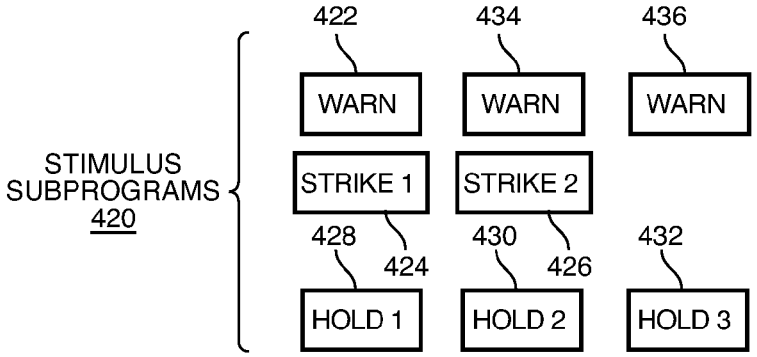
Figure 4C:
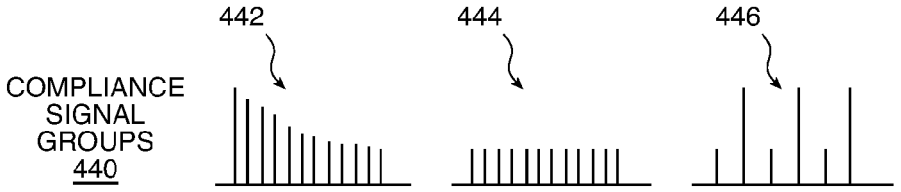
Figure 4D:
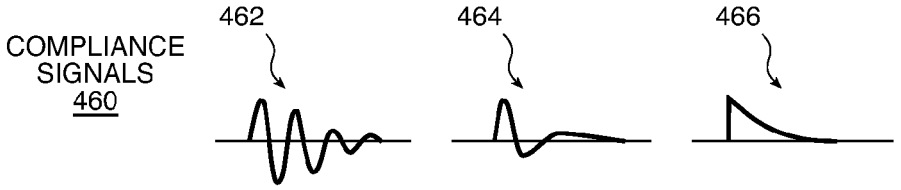

A stimulus signal, according to various aspects of the present invention may include a stimulus program having one or more stimulus subprograms, compliance signal groups, and/or compliance signals. For example and for clarity of presentation, consider the stimulus programs 420 and component parts illustrated in FIGS. 4A through 4D. In FIG. 4A, two stimulus programs 402, 404 are illustrated.

Stimulus program 402 consists of a warn stage. Stimulus program 402 may follow operation of a warn control. A warn stage in one implementation does not stimulate a target electrically. Nevertheless, a warn stage may use a stimulus signal generator to provide an arc across terminals of electronic weapon system 100 for the warn function as discussed above so as to eliminate a need for additional warn function circuitry. A warn stage in a first implementation cannot provide a current through tissue of the target (e.g., warning function terminals are not located on an open face of electronic weapon system 100). A warn stage in another implementation may provide the warn function and also provide a local stun function having a current through tissue of the target. In a preferred implementation, the stimulus signal generator is used to provide the warn function and is suitable for a warning arc and for conducting a strike or a hold stage current through tissue of the target as a local stun function.

Stimulus program 404 consists of 5 stages in sequence: a strike stage from time T1 to time T2, a rest stage from time T2 to time T3, a hold stage from time T3 to time T4, another rest stage from time T4 to time T5, and a hold stage from time T5 to time T6. Stimulus program 404 may follow operation of a trigger control. The relative durations of stages may be other than as shown and any may be extended in duration 406 as discussed above.

An advise stage is shown following the stimulus program 404 to illustrate an ad hoc stage.

A stimulus program comprises any suitable sequence of stimulus subprograms. According to various aspects of the present invention, a library of stimulus subprograms may be defined and stored in memory of electronic weapon system 100. For example, library of stimulus subprograms 420 includes WARN subprogram 422, STRIKE1 subprogram 424, STRIKE2 subprogram 426, HOLD1 subprogram 428, HOLD2 subprogram 430, HOLD3 subprogram 432, ADVISE1 subprogram 434, and ADVISE2 subprogram 436. Each subprogram (e.g., 422) includes one or more compliance signal groups (e.g., 440).

A compliance signal group (e.g., 442) includes a plurality of compliance signals (e.g., 460). For example, when all compliance signals are identical and regularly separated in a sequence in time, the compliance signal group (e.g., 442, 444) may be characterized by a repetition rate. In other implementations, a compliance signal group may include a variety of different compliance signals (e.g., different purposes such as to primarily cause pain and/or to primarily interfere with skeletal muscles) and a variety of separations (e.g., increasing, decreasing, increasing and decreasing, random).

A compliance signal (e.g., 462) may be sufficient to ionize air in an intervening air gap, cause pain to be felt by the target, and/or interfere with the target's control of one or more of its skeletal muscles. When the compliance signal causes pain and/or contraction of a skeletal muscle, the duration of the pain and/or contraction may define a period of time referred to as an effective duration of a compliance signal. An effective duration may be defined with reference to a waveform of a compliance signal into a model of the tissue of a standard target. A standard target may have average characteristics of a population of typical targets. The inventors have found that a resistance (RB) of about 400 ohms is a suitable model for an adult human target in good health and not under the influence of narcotics or alcohol.

A compliance signal may have a waveform consistent with a resonant circuit response driving a load. A resonant circuit driving a load may provide a waveform of the type known as an underdamped 462, of the type know as critically damped 464, or of the type known as overdamped 466. Variations in appearance between these types are possible depending on the resonant circuit and the load. For the model of the tissue of a standard target discussed above, the waveform provided by circuits disclosed herein is typically underdamped.

The waveform across RB may comprise a series of portions that each appear as underdamped, critically damped, and overdamped. The combination (e.g., shaped) waveform may be provided by a first circuit configuration (e.g., according to FIG. 8A with switch SWA closed) for creating arcs to complete a circuit for conducting a stimulus current through tissue of the target; and by a second circuit configuration (e.g., according to FIG. 8B with switch SWB closed) for maintaining the stimulus current flow. The source impedance and load in the first configuration may differ from the source impedance and load in the second configuration. Further, the tissue of the target may present a changing load (e.g., different resistances) as a function of the current, charge, and/or local heating produced by the current. Consequently, the waveform may appear to be (in any combination) underdamped, critically damped, or overdamped during the operation of the first configuration and appear to be underdamped, critically damped, or overdamped during the second configuration. Configuration may change in response to any switching technique (e.g., spark gaps, semiconductor switches) discussed herein.

Generally, a compliance signal group (e.g., 442) accomplishes the purpose of a stage (e.g., strike, hold, advise). Compliance signals (e.g., 462) may be tailored in intensity (e.g., quantity, rate, or amplitude of energy, current, voltage, or charge). Consequently, compliance signal groups 440 may include uniform compliance signals 444 or a series of different compliance signals 442, 446. Generally, a more intense compliance signal incurs a greater energy expenditure from the launch device. A relatively higher intensity compliance signal may have suitable characteristics for stopping a target. A relatively lower intensity compliance signal may be sufficient to advise the target to comply with the operator of the launch device through discomfort and/or pain as opposed to being sufficient to significantly interfere with the target's use of its skeletal muscles. One or more compliance signal groups of a stimulus subprogram may be identical or may form a series of different compliance signal groups. Variation in compliance signals 460, compliance signal groups 440, stimulus subprograms 420, and stimulus programs 440 may be responsive to estimated battery capacity to conserve battery capacity.

Compliance signals may be interleaved and in series. For example, higher and lower intensity compliance signals 446 may be delivered to the same target. In another example, a series of compliance signals may be delivered to multiple targets simultaneously. In still another example, a series of compliance signals may be delivered to several targets where each target receives a next compliance signal of the series. For instance, the compliance signal (e.g., one pulse per target) received by each target may have a pulse repetition rate, consequently the pulse repetition rate of the series may be a multiple of the pulse repetition rate received by each target.

A method for stimulus tailoring, performed by processing circuits 130 according to various aspects of the present invention, may include in any practical order, one or more of the following operations: (a) determining a privilege of the operator as to a right to specify tailoring of the stimulus program; (b) determining a description of all operational cartridges; (c) determining an operator preference for a local stun function capability; (d) determining an operator preference for a remote stun capability; (e) determining an operational capacity of the launch device; (f) advising the operator when the operator's preference cannot be met (e.g., operator prefers stimulus greater than operational cartridge capabilities or greater than launch device capacity); (g) determining a tailored stimulus program, a stimulus subprogram, a compliance signal group having uniform compliance signals, and/or a compliance signal group having various intensities of compliance signals (e.g., linearly decreasing, linearly increasing, alternating high and low intensity, to name a few intensity profiles); storing and/or communicating a description of the tailored stimulus program in association with identification of the operator; and issuing controls to a stimulus signal generator to accomplish a tailored stimulus program.

A method of data recording performed by processing circuits 130 according to various aspects of the present invention, may include in any practical order, one or more of the following operations: (a) outputting to an operator an audible prompt for information from the operator; (b) receiving a voice response by the operator; (c) storing or communicating the voice response; (d) determining a symbol corresponding to the voice response; and (e) storing or communicating the symbol. Data recording may be desired for so-called 'use of force' reports associated with operation of the launch device. A prompt may be an abbreviated suggestion of a full request for information set forth on a written instruction sheet used by the operator to accomplish preparing a 'use of force' report. When the prompt is a complete request for information, no written instruction sheet need be used. An operator interface similar in some respects to a conventional stenographer's memo recorder may be implemented to allow reviewing and editing of voice responses. Communication of the voice responses or symbolic voice responses may be buffered as discussed above. Storing and/or communication may include associating an identification of the operator with the information being stored or communicated.

A method of data communication performed by processing circuits 130 according to various aspects of the present invention, may include in any practical order, one or more of the following operations: (a) determining an identification of the operator of the launch device; (b) determining an identification of the launch device; (c) determining a physical location of the launch device; (d) determining whether a link is available for communication; (e) receiving from the communication link a request for information; (f) preparing information comprising at least one (or all) of the identification of the operator, the identification of the launch device, and the physical location of the launch device; and (g) transmitting the information onto the link. To determine whether a link is available for communication, launch device 300 may be used in conjunction with a cradle (not shown) that links optical I/O of the cradle with optical I/O of a display 314. Bus 304 may be extended to provide a wireless link for data communication with a cradle (not shown) that also provides recharging energy for battery 322 without removing rechargeable subassembly 321 from launch device 300.

A launch device, according to various aspects of the present invention, includes operator controls located for convenient and intuitive use by the operator. For example, a handgun type launch device 500 or 570 of FIGS. 5 and 6 includes body 501, handle 502, safety control 504, trigger control 506, stimulate control 508, operator preference control 510, menu control 512, a rechargeable subassembly 532 installed into a bottom face 530 of handle 502, a module bay 540 having ports for installation of modules (a lighting module 542 shown), a display 602 (FIG. 6), and laser target illuminator 516.

Figure 5A:
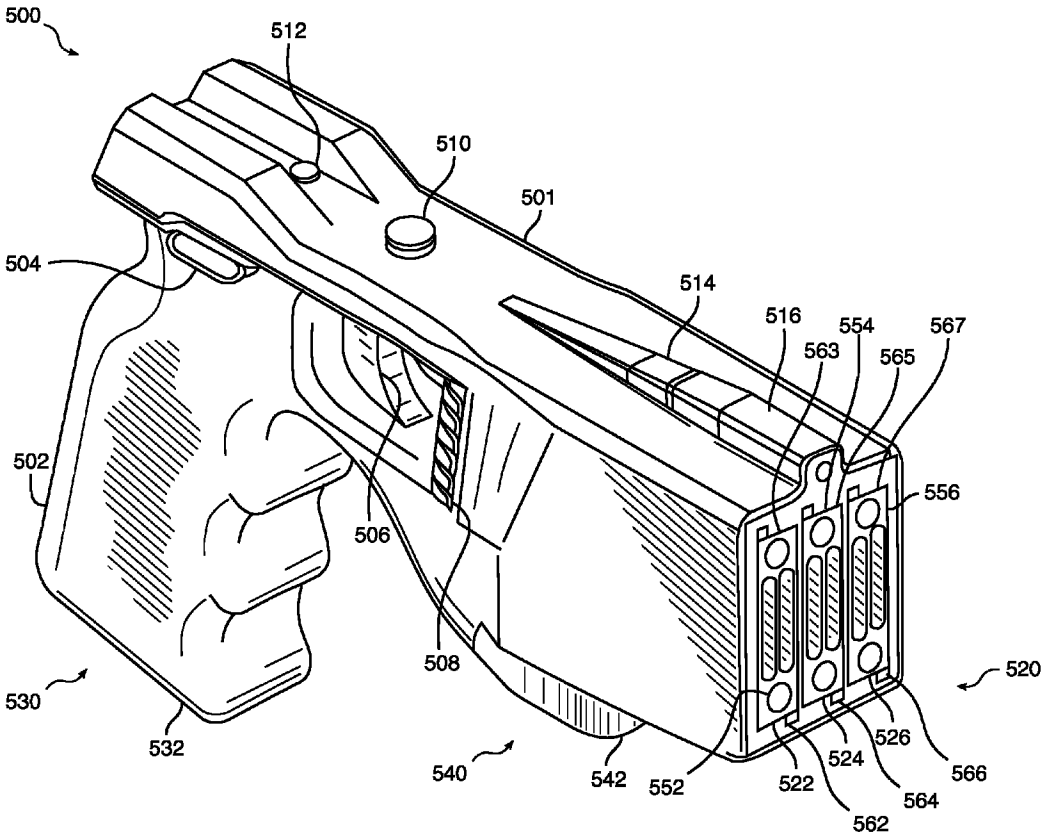
FIGS. 5A and 5B are front perspective views of two implementations of the system of FIGS. 1A and 1B.
Figure 5B:
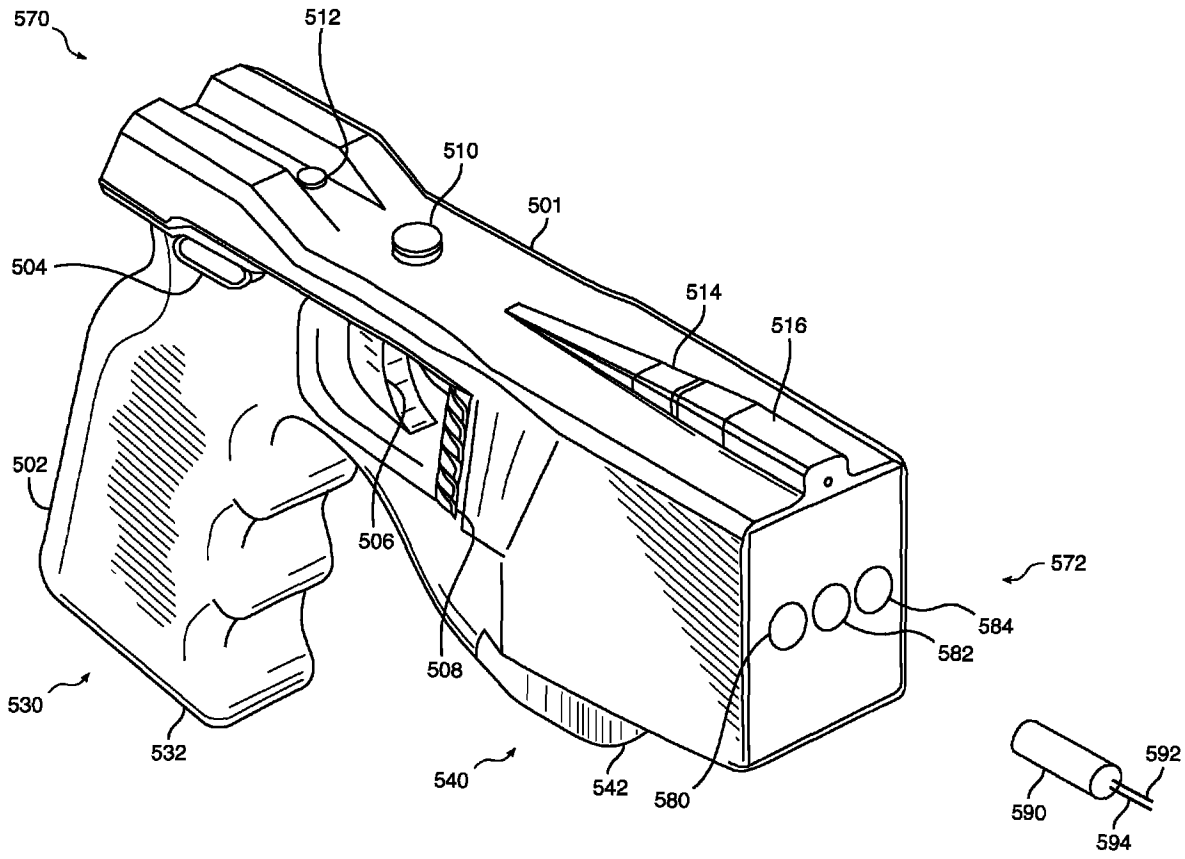
Figure 6:
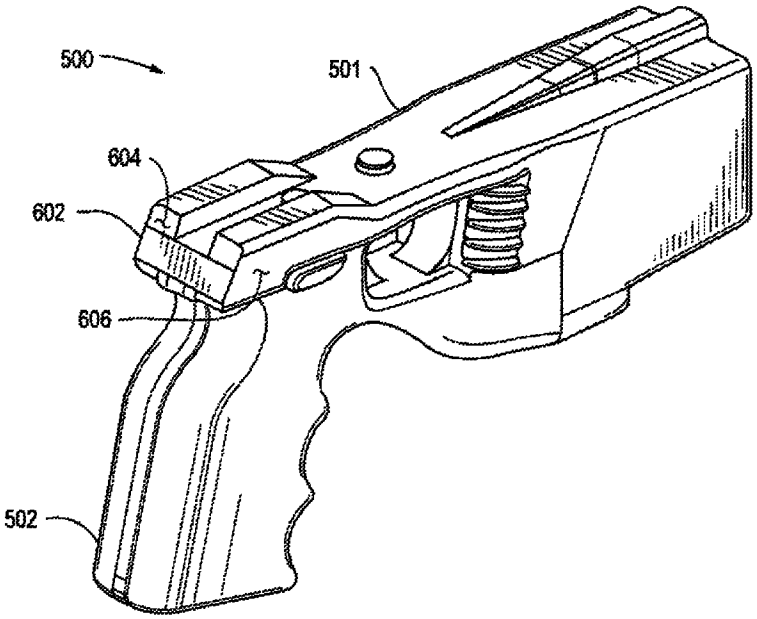
FIG. 6 is a rear perspective view of a gun implementation of the system of FIG. 1A or 1B.
Figure 7:
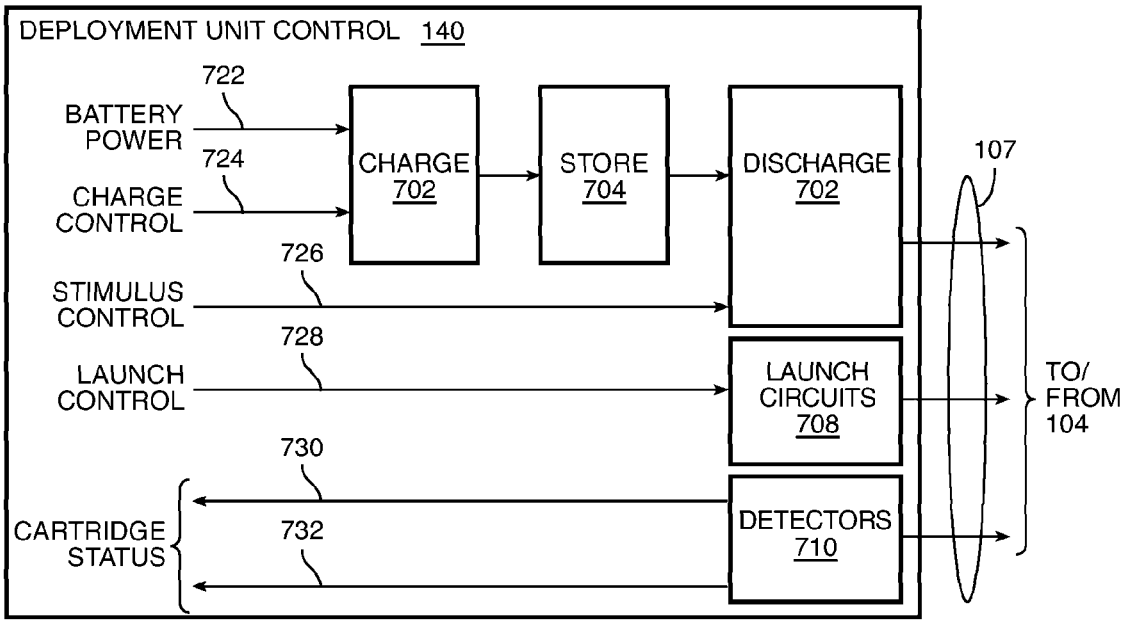
FIG. 7 is a functional block diagram of the deployment unit control function of the system of FIG. 1A or 1B.

Launch device 500 of FIGS. 5A and 6 further includes a plurality of bays 552, 554, 556 each bay having two terminals 562 (564, 566) and 563 (565, 568) respectively. Each bay may receive one cartridge. Cartridges 522, 524, 526 are installed (e.g., inserted, received) into a respective bay 552, 554, 526 of front face 520 of launch device 500. Cartridge eject control 514 may be operated to eject one or more of cartridges 522, 524, 526. In FIG. 5, cartridges 522, 524, and 526 are shown without the front cover on each cartridge. Consequently, the circular delivery tubes for electrodes and the oval wire stores are visible. If all three cartridges were spent, device 500 would appear with one filament wire extending from each oval wire store. Each cartridge 522, 524, and 526 has two terminals (not shown), one for each wire store, to support an arc with two respective terminals of launch device 500 as shown. Terminals 566 and 567 of bay 556 of launch device 500 are symmetrically located with respect to cartridge 526, and support arcs for cartridge 526. Terminals 562 (564) and 563 (565) of bay 552 (554) are located symmetrically for analogous functions.

Launch device 570 of FIG. 5B further includes orifices (e.g., apertures, bores, chambers) 580, 582, and 584 at front face 572 for receiving projectiles for launch. Orifices 580, 582, and 584 may be integral to body 501 and projectiles inserted into each orifice as necessary by a user. Orifices 580, 582, and 584 may be part of a pre-loaded subassembly (e.g., magazine) that contains projectiles and mechanically couples to weapon 570 for operation, but that is discarded once all projectiles have been launched from the sub-assembly. Operation of a control, as discussed above, launches projectile 590 toward a target. Contactors 592 and 594 couple to a target to provide the stimulus signal. A projectile may be activated to provide a first stimulus signal responsive to launch and additional stimulus signals responsive to receiving information via transmission.

Safety control 504, according to various aspects of the present invention, may be implemented as a two position rotary lever on each side of body 501. By locating a small magnet inside each lever, and locating reed relays inside body 501 at the extremes of the rotary motion of each lever, detection of the position of the lever may be accomplished without compromising a hermetic seal of body 501. In another implementation, levers on each side are mechanically coupled together to move as a unit, and the magnetic components are omitted with respect to one of the levers.

According to various aspects of the present invention, a lever may implement more than one control. For example, three positions of lever 504 may implement a combination of functions for the safety control (504) and the operator preference control (510). For instance, the operator preference function may indicate a "range" (effective distance) preference of the type discussed with reference to control 510. The three positions may be as follows: (1) safety on; (2) safety off and range preference is short; and (3) safety off and range preference is long. Control 510 may be omitted or used for a different preference (e.g., a stimulus tailoring preference, an illumination preference, a radio link preference) or a different control (e.g., a warn function separate from the stimulate function, as discussed above).

Trigger control 506, according to various aspects of the present invention, may be implemented as a two position rotary lever pivoted on an axis within body 501 and equipped with a spring return to imitate the feel of a conventional pistol. The movable portion of trigger control 506 may include a magnet for activation of a reed relay within body 501, so that detection of the position of the lever may be accomplished without compromising a hermetic seal of body 501. An operator squeezes the trigger lever into handle 502 to set the control and releases the trigger lever to release the control.

Stimulus control 508, according to various aspects of the present invention, may be implemented as a two position spring return button having a magnet in the movable portion and a reed relay within body 501, so that detection of the position of the button may be accomplished without compromising a hermetic seal of body 501. Operationally, stimulus control 508 may seem to the operator as a normally open momentary contact switch. An operator presses the button into body 501 to set the control and releases the button to release the control.

Operator preference control 510 according to various aspects of the present invention, may be implemented as a two position spring return button having a magnet in the movable portion and a reed relay within body 501, so that detection of the position of the button may be accomplished without compromising a hermetic seal of body 501. An operator presses the button into body 501 to set the control and releases the button to release the control.

Menu control 512 may be implemented in a manner analogous to operator preference control 510.

A cartridge eject control 514 (e.g., a release) mechanically disengages a cartridge retention latch for some or all cartridges in front face 520. An operator may choose to remove cartridges (e.g., cartridge 522 because it was spent) or replace and reseat cartridges (e.g., replace short range cartridge 524 with a long range cartridge). Cartridge eject control 514 may further release some or all projectiles from orifices 580, 582, and 584.

Target illumination may be provided by laser or general illumination (e.g., spot light, flood light). For example, laser illumination for identifying a particular target (e.g., for sighting a launch, tactical coordination visible to other law enforcement officers, and/or providing context for video recording), may be provided by laser target illuminator 516 and/or by an auxiliary lighting function 328, 540. Laser target illumination 516, 540 may cooperate with a range finding function discussed above. For example, any suitable modulated illumination may be provided by laser 516 for reception by a photo detector of an auxiliary module in bay 540.

Handle 502 has a cavity for accepting a rechargeable subassembly 532 upward into the bottom face 530 of the handle. In one implementation, the rechargeable assembly includes a camera (not shown) having a lens facing toward the target.

Display 602 displays any information discussed above (e.g., operating information, configuration information, status, battery capacity, test results, visual prompts, menus for selecting information to display and configuration settings to review and/or revise). Display 602 may be used as an optical I/O transmitter and/or transceiver for data communication function 124 (318) as discussed above.

A microphone may record audio of the operator's voice (e.g., impromptu tactical dialog, responses to prompts, audio directed to the target), ambient audio, or audio from the direction of the target. One or more microphones (not shown) may be located in one or both symmetrically arranged surfaces 604 above display 602. A microphone (not shown) may be located in front face 520 sensitive along an axis directed toward the target.

A speaker may provide audio prompts to an operator, to tactical assistants to the operator, or to a target (e.g., warning or public address). Surfaces 604 or 606 may include one or more speakers (not shown) (e.g., symmetrically with respect to a center of body 501). A first or one or more additional speakers may be located to the rear of module bay 540, on the sides of body 501 or on the under side of body 501 below the stimulate control 508. A conventional omnidirectional audio radiator may be used in any of the above locations for audio directed to the operator, to the target, or both.

A deployment unit control provides circuits that interact with digital controls from processing circuits 130 and circuits that interact with one or more deployment units having indicators and cartridges. An interface between processing and deployment unit control functions may include a charge control signal, a stimulus control signal, and a launch signal. For example, by including charge control signal 724 that is functionally independent of stimulus control signal 726, stimulus program tailoring is facilitated including specification, by processing circuits 130, of parameters that define or revise one or more of the following: a compliance signal (of 460), a compliance signal group (of 440), a stimulus subprogram (of 420), and a stimulus program (of 410). According to various aspects of the present invention, deployment unit control 140 of FIGS. 1 and 7 includes charge function 702, store function 704, discharge function 706, launch circuits 708, and detectors 710. Launch circuits 708 provide signals 730 and may operate as discussed above with reference to launch control 144. Detectors 710 provide signals 732 and may operate as discussed above with reference to detector 143. Charge function 702, store function 704, and discharge function 706 may cooperate to implement a stimulus signal generator as discussed above. Processing circuits 130 may receive digital (e.g., results from analog to digital conversion) feedback signals (not shown) from charge function 702, store function 704, and/or discharge function 706. Processing circuits 130 receive other feedback information including cartridge status (730, 732).

A charge function, according to various aspects of the present invention, receives battery power and provides energy to an energy store at a voltage higher than the battery power without exceeding the current and voltage capability of the battery. A circuit performing the charge function may provide energy in pulses having a duty cycle, a pulse repetition rate, and respective pulse amplitudes. These parameters may be uniform throughout charging or may be adjusted by processing circuits in response to detected conditions of the battery and detected conditions of the store function. Charging in response to a charge command meaning of the charge control signal may be accomplished for one or for a set of compliance signals. In one implementation, charge function 702 receives battery power signal 722 and charge control signal 724 and provides energy to store function 704. Charge control signal 724 may include one or more digital and/or analog signals for conveying specifications to charge function 702.

A store function, according to various aspects of the present invention, receives energy to be stored from a charge function and accumulates received energy for discharging. Storage may be accomplished with inductive or capacitive components. For example, store function 704 includes one or more capacitors collectively referred to as a capacitance.

A discharge function, according to various aspects of the present invention, receives energy from a store function and provides, in response to a stimulus control signal, one or more compliance signals to a deployment unit for a local stun function or a remote stun function. A circuit performing the discharge function may provide a stimulus program, a stimulus subprogram, a compliance signal group, or a compliance signal as specified by processing circuits. The parameters of a stimulus program, stimulus subprogram, compliance signal group, and compliance signal may be conveyed to the discharge function by a stimulus control signal. For example, processing circuits 130, having knowledge of the voltage and capacitance of store 704 (e.g., by software configuration settings, by feedback signals) may specify an amplitude and/or a duration of one or more compliance signals and convey this specification via stimulus control signal 726 to discharge function 706. Discharge control signal 726 may include one or more digital and/or analog signals for conveying specifications to discharge function 706. The amplitude and duration in one implementation is sufficient to transfer about 100 microcoulombs of charge into the tissue of the target per compliance signal when interference with the target's control of its skeletal muscles is desired. A compliance signal group may be characterized by a repetition rate of compliance signals of about 15 to 19 per second for a duration of about 5 to 10 seconds when interference with the target's control of its skeletal muscles is desired. Less transferred charge per compliance signal, fewer compliance signals per second, and/or a shorter duration of the compliance signal group may constitute a suitable compliance (e.g., warning) effect on the target.

A compliance signal may be produced by discharge function 706 by coupling energy from a first capacitance of store 704 at a first voltage suitable for establishing one or more arcs to complete a circuit through the target and, after time sufficient for arc formation has lapsed, coupling energy from a second capacitance at a second voltage lower voltage than the first voltage for delivering the remainder of the compliance signal. Discharging in response to a discharge command meaning of the discharge control signal may be accomplished for one or for a set of compliance signals.

Figure 8A:
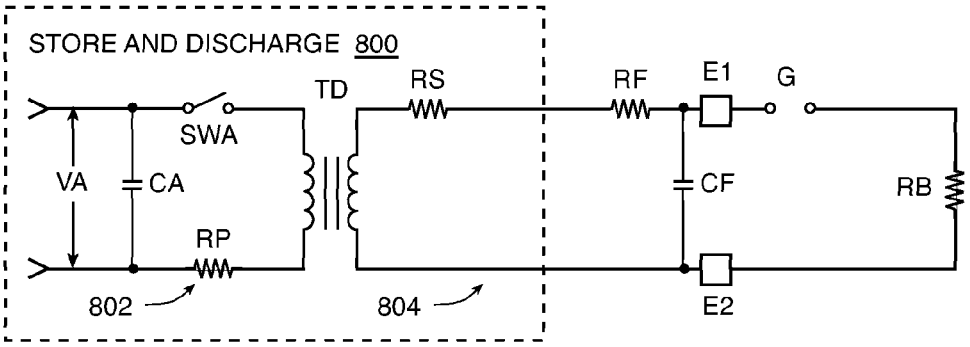
FIGS. 8A and 8B are schematic diagrams of models of the cooperation of the system of FIG. 1A or 1B and a target.
Figure 8B:
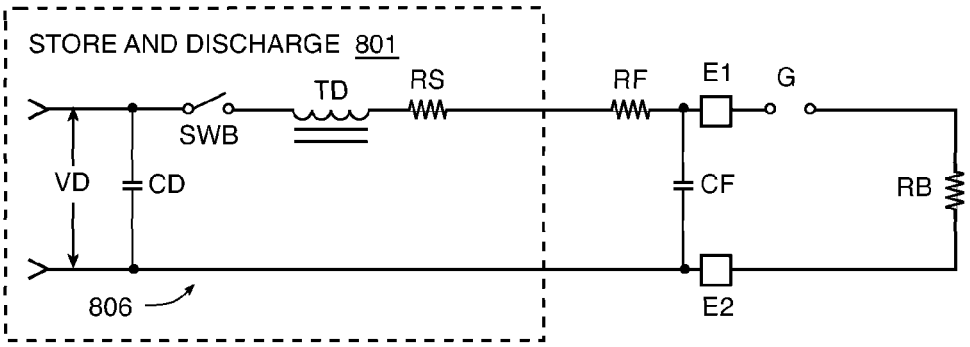

Each compliance signal when applied to a target may exhibit underdamped, critically damped, or overdamped electrical waveform characteristics. FIGS. 8A and 8B show a simplified electrical model of the store and discharge functions (800, 801) coupled by a deployment unit to a target for a remote stun function. Components of FIGS. 8A and 8B are electrically perfect as is typical for circuits for modeling electrical phenomena. In FIG. 8A, a primary circuit 802 includes a capacitance CA of a store function coupled via a switch SWA to the primary of a step-up transformer model TD having a primary winding resistance RP. Capacitance CA stores an energy at a voltage VA according to the expression 0.5*CA*VA2. A secondary circuit 804 included the secondary of the transformer TD having a secondary winding resistance RS, the filaments of the deployment unit (e.g., tether wires connecting the discharge function to electrodes that impale the target's clothing or skin) modeled as a resistance RF and a capacitance CF, and a target resistance modeled as RB. Terminals E1 and E2 correspond to electrodes that are launched toward the target and finally rest near or in the tissue of the target. At the voltages and currents of a suitable compliance signal, a human body has little electrical reactance, however the value of RB is different for amplitudes, different waveforms, and different repetition rates. The combined effect of all gaps to be bridged prior to transferring a charge to the target are shown as a model spark gap G. Note that energy stored for delivery of a compliance signal is not entirely delivered and dissipated in resistance RB; and that the voltage across RB is the result of a voltage divider comprising RS, RF, and RB. The model of FIG. 8B represents electrical conditions after spark gaps conduct forming a complete circuit through tissue of the target. Here, a capacitance model CD of a store function is coupled via a switch model SWB through the secondary winding of transformer model TD. Capacitance CD stores an energy at a voltage VD according to the expression 0.5*CD*VD2. Note that a compliance signal waveform may have an overdamped, critically damped, or underdamped waveform modeled in secondary circuit 804 that differs from the overdamped, critically damped, or underdamped waveform modeled in circuit 806. As before, the energy stored for delivery of a remainder of a compliance signal is not entirely delivered and dissipated in resistance RB.

The models of FIGS. 8A and 8B may apply to a local stun function with the omission of the resistance and capacitance of the filament wires to electrodes. Specifically, RF and CF may be omitted. Terminals E1 and E2 of the model correspond to terminals brought near or brought into contact with the target.

Figure 9:
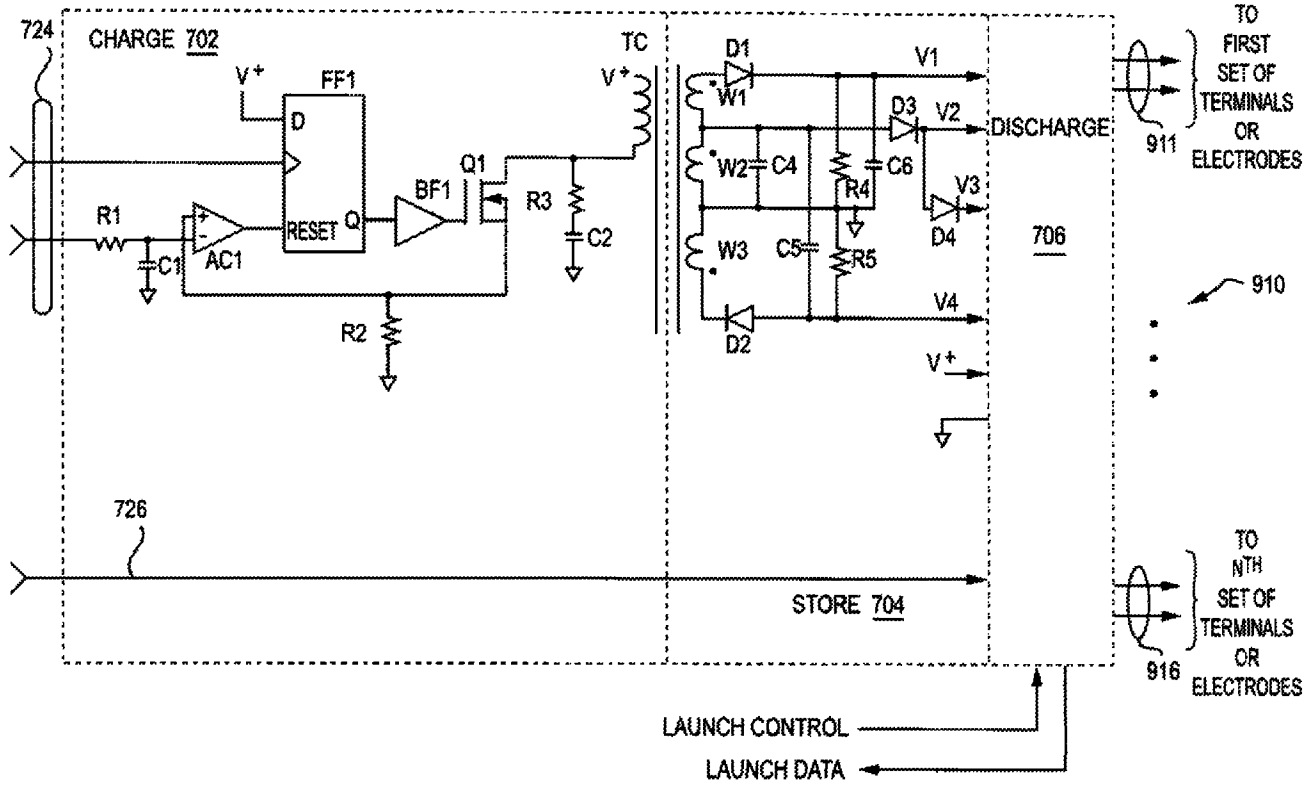
FIG. 9 is a schematic diagram of a portion of the deployment unit control function of FIG. 7.
Figure 10:
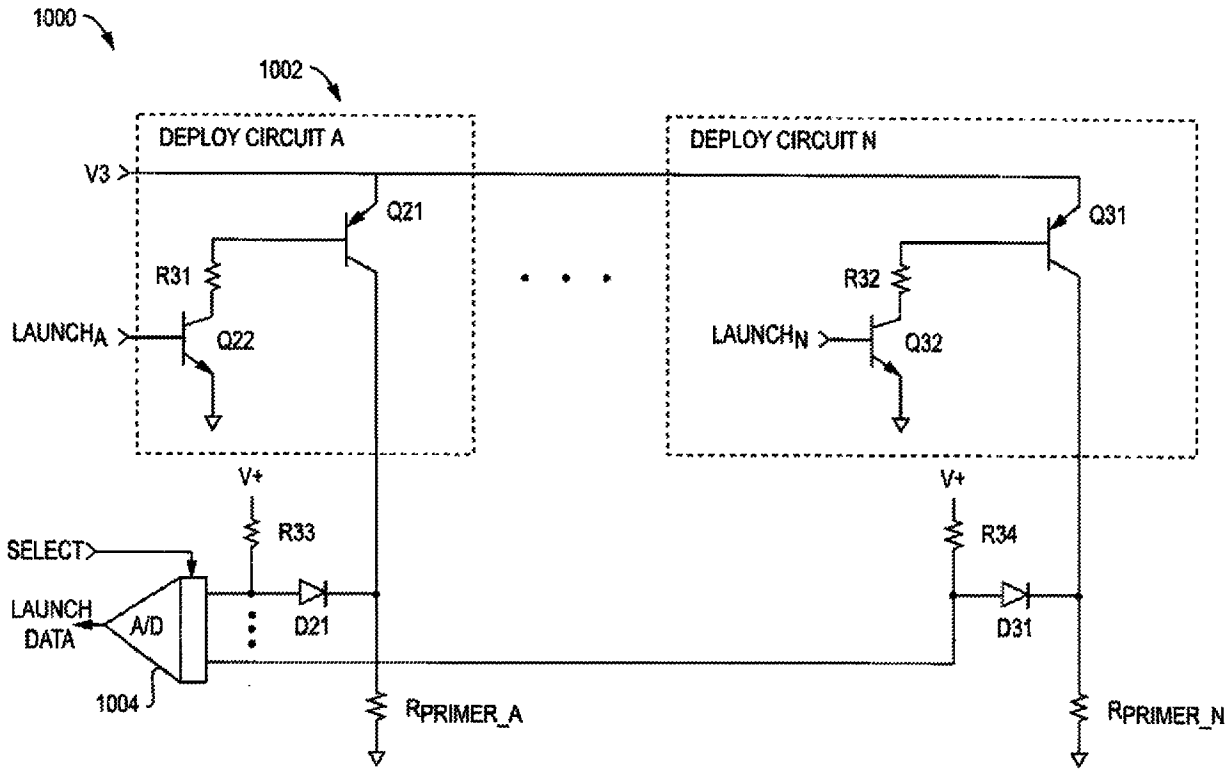
FIG. 10 is a schematic diagram of a portion of the discharge function of FIG. 9.

A deployment unit control as discussed above may be implemented, according to various aspects of the present invention, using circuit techniques illustrated in FIGS. 9 through 16. The deployment unit control of FIG. 9 includes charge function 702, store function 704, and discharge function 706. Discharge function 706 provides a plurality 910 of pairs of conductors (911, 912 (not shown), 916) that are part of interface 107 to one or more deployment units 104 discussed above. In FIG. 9, store function 704 is implemented with three capacitances, each having a different plate-to-plate voltage. In one implementation, windings W1, W2, and W3 have respective nominal voltage specifications of 2000, 1000, and 2000 volts with winding W3 in an opposite polarity as to windings W1 and W2. Windings W1 and W2 in series provide charge pulses having amplitude(s) up to about 3000 volts peak to charge capacitance C6 up to about 3000 volts. Windings W2 and W3 in series provide charge pulses having amplitude(s) down to about −3000 volts peak to charge capacitance C5 down to about −3000 volts. Winding W2 provides charge pulses having amplitude(s) up to about 1000 volts peak to charge capacitance C4 up to about 1000 volts. The voltage of capacitances C4, C5, and C6 may be sampled and fed back to processing circuits 130. The effectiveness of charging may be determined by processing circuits 130. A forecast of a brown-out condition of battery 322 may be calculated by processing circuits 130. Consequently, adjustment of a charging pulse amplitude, a stimulus program, a stimulus subprogram, a compliance signal group, or a compliance signal intensity may be made to reduce the risk of the possibility of a brown-out condition. Further, a policy may be followed instead of an operator preference; and, notices to the operator may be provided when the operator preference is not being followed.

A launch control circuit according to various aspects of the present invention may provide indicia of readiness (730) for each of several cartridges and respond to a digital launch control signal (728) for each launch. For example, launch control circuit 1000 of FIG. 10 includes a digital feedback circuit and a plurality 1002 of deploy circuits A through N.

Any conventional digital feedback circuit may be used to provide launch data (e.g., comprising cartridge status such as indicia of readiness) including a comparator (e.g., for a threshold or a window between limits), an A/D converter 1004 (as shown), or a microcontroller comprising A/D, D/A, and/or comparator functions.

Each deploy circuit provides a relatively low voltage (e.g., having a peak voltage amplitude of less than about 1000 volts, preferably less than about 300 volts, such as about 150 volts) pulse of current sufficient to activate a conventional pyrotechnic primer (modeled as a resistance $R_{PRIMER\text{-}A}$ through $R_{PRIMER\text{-}N}$) as discussed above. Processing circuits 130 have independent control of each primer A through N. Processing circuits 130 may monitor the resistance of each primer, for example, to distinguish whether a particular primer is ready, whether it is spent, and/or to identify a functional capability of a cartridge (e.g., an electrical characteristic may be an indicator (112) describing the cartridge as discussed herein).

In another implementation according to various aspects of the present implementation, detecting characteristics of the primer serves both launch and indicator functions. For example, $R_{PRIMER}$ may be an impedance ($Z_{PRIMER}$) having electrical properties that serve as an indicator (112) as discussed above. Electrical properties may be determined using impulse, pulse, frequency, or frequency sweep waveforms. Any conventional detector (143) for amplitude, phase, or frequency may be used to determine indicia to be associated with the cartridge or magazine in which the $Z_{PRIMER}$ impedance is located. A memory 320, 326 may include a table cross-referencing an electrical characteristic with a suitable description of the cartridge.

A stimulus control circuit according to various aspects of the present invention may provide relatively high voltage compliance signals as directed by processing circuits 130. For example, stimulus control circuit 1100 of FIG. 11 responds to a plurality of stimulus control signals, one for each pair of terminals or electrodes. Stimulus control circuit 1100 includes a plurality 1102 of stimulate circuits, each supporting one pair of terminals or electrodes for a local or a remote stun function. Each stimulate circuit 1104, 1106 has a step-up transformer TD1106, TD1126 having a primary winding and a pair of secondary windings. Each primary winding is in series with an independent SCR Q1106, Q1126 operating as a switch. The gate of each SCR is driven by a the respective stimulus control signal (A through N) amplified by a transistor circuit consisting of Q1102 and R1102 to provide gate signal SCA (Q1104 and R1104 providing SCN). Each secondary circuit includes a secondary winding of the transformer coupled from one side to a source of stored energy (e.g., capacitances C5 or C6) and coupled from the other side to a terminal or electrode. Consequently, when, for instance, one stimulus control signal (STIMULUS $CONTROL_A$) is asserted, SCR Q1106 conducts to allow a third source of stored energy (e.g., capacitance C4) to discharge through one primary winding. As a result of the initial discharge, a high voltage pulse (e.g., about 50,000 volts) is available across the terminals or electrodes 911 for ionizing air in any air gap in series with the terminals or electrodes. After ionization, capacitances C5 and C6 pass a discharge current through the ionized air and through the target. Note that the same set of capacitors may be reused for each stimulate circuit signal desired (e.g., 911 and/or 916). Consequently, providing stimulus to several targets is accomplished by asserting a stimulus control signal for each target in turn. Compliance signal groups or stimulus subprograms may be interleaved.

In another stimulus control circuit, according to various aspects of the present invention, several sets of terminals and electrodes (910) may conduct independent stimulus signals simultaneously. For example, stimulus control circuit 1200 of FIG. 12 responds to one stimulus control signal, SCA as discussed above, to simultaneously provide an electrically independent stimulus signal to each of N pairs of terminals or electrodes. Ionization is accomplished simultaneously for all pairs of terminals or electrodes from a single source of stored energy (e.g., capacitance C4) in series with all primary windings. Each secondary circuit includes an independent energy store for supporting current through each target after ionization. As shown, the secondary circuits of transformer TD1202 include capacitors C1202 and C1204; and the secondary circuits of transformer TD1222 include capacitors C1222 and C1224.

In another stimulus control circuit, according to various aspects of the present invention, operation of terminals and electrodes (910) may be independent (e.g., as in circuit 1100) or simultaneous (e.g., as in circuit 1200). For example, stimulus control circuit 1300 of FIG. 13 includes a plurality 1302 (quantity N) of stimulate circuits 1304 through 1306 each responsive to a respective stimulus control signal SCA through SCN (as discussed above with reference to FIG. 11). Each stimulate circuit includes a transformer having a primary winding and a secondary winding for each of terminal or electrode (two secondaries shown). Each secondary circuit includes a capacitance for continuing a current through the target after ionization.

Figure 11:
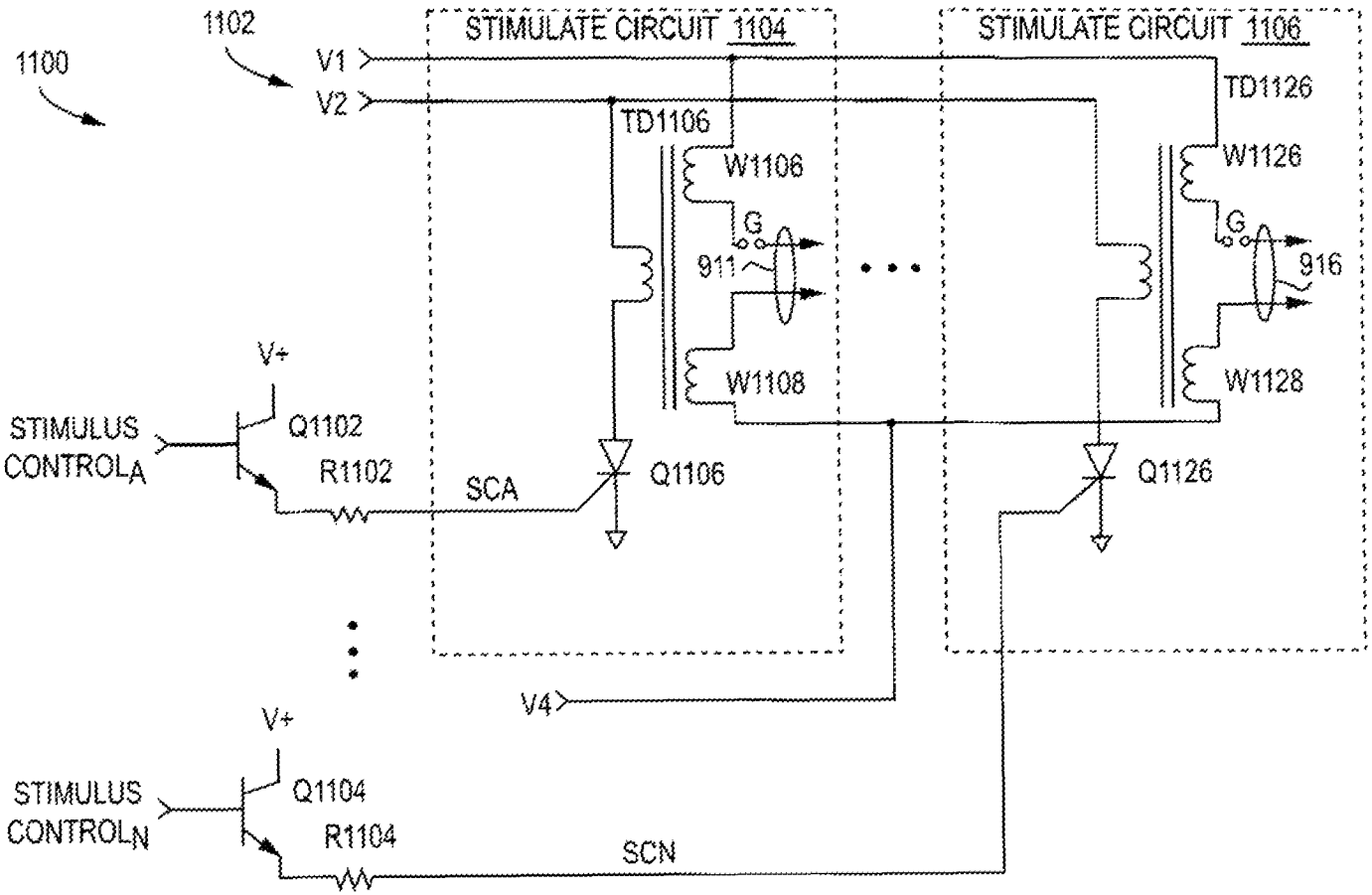
FIGS. 11 through 16 are schematic diagrams of implementations of a portion of the discharge function of FIG. 9.
Figure 12:
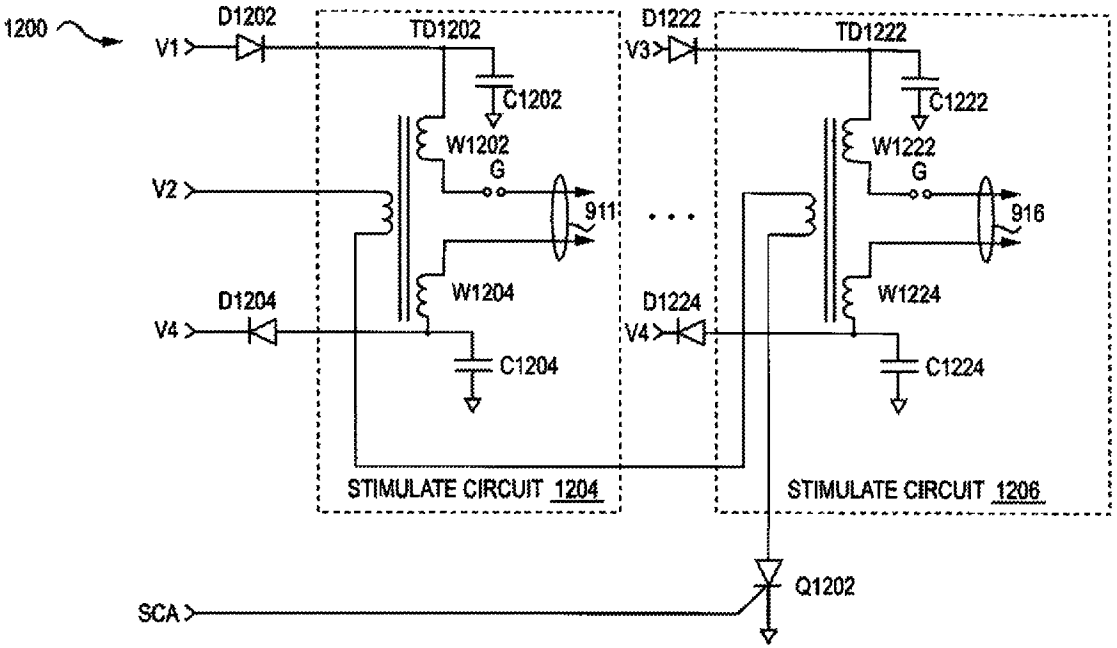
Figure 13:
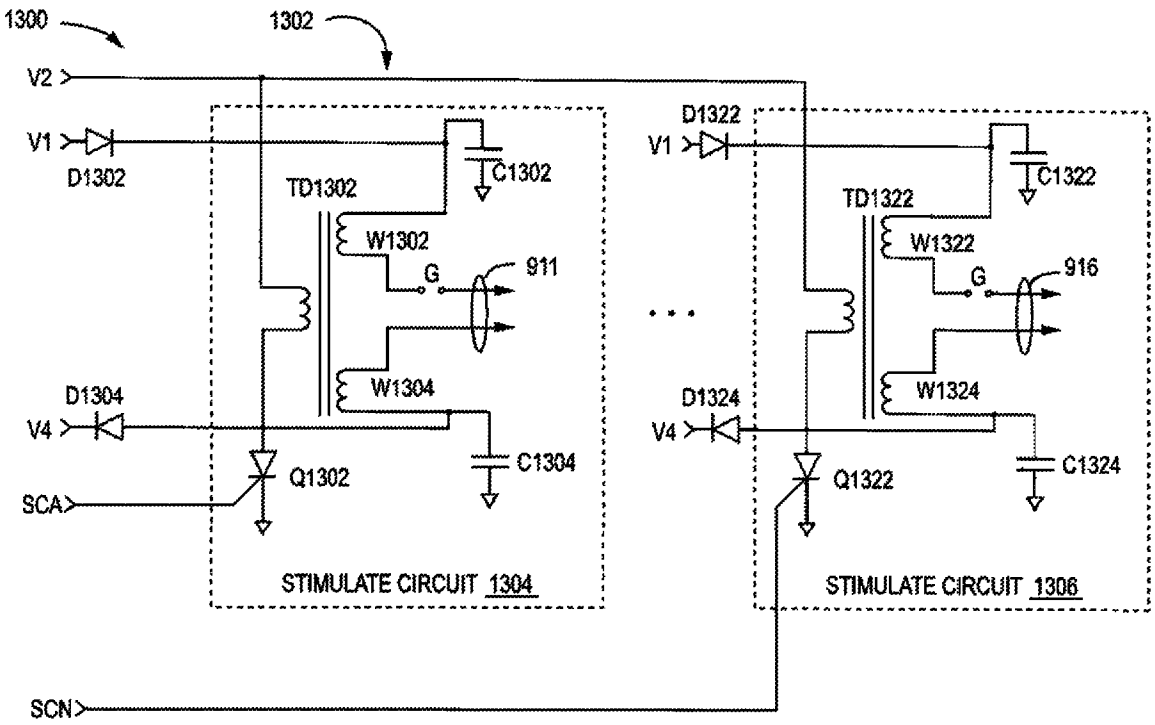
Figure 14:
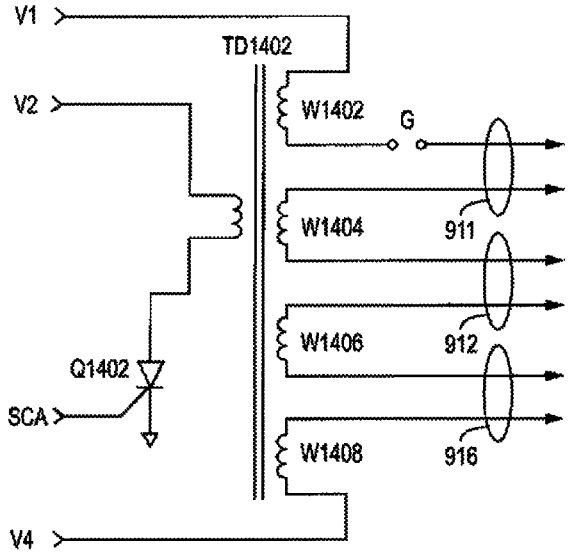

A transformer may support one pair of terminals or electrodes as shown in FIGS. 11, 12, and 13. In other stimulus control circuits, according to various aspects of the present invention, a transformer may support a plurality of pairs of terminals or electrodes. As a first example, transformer TD 1402 of FIG. 14 may be substituted for any transformer of any particular stimulate circuit of FIGS. 11, 12, and 13 to support three pairs of terminals or electrodes for that particular stimulate circuit. Transformer TD 1402 includes secondary winding W1402 coupled on one side to a first storage capacitance (e.g., C6) for providing a current through the target after ionization and on the other side to a first terminal or electrode. Transformer TD1402 further includes secondary winding W1404 coupled to the second terminal or electrode of the first pair 911 and coupled to a third terminal or electrode. Transformer TD 1402 further includes secondary winding W1406 coupled to a fourth terminal or electrode of the second pair 912 and coupled to a fifth terminal or electrode. Transformer TD1402 still further includes secondary winding W1408 having a first side coupled to a sixth terminal or electrode of the third pair 916 and coupled to a second storage capacitance (e.g., C5) for providing a current through the target after ionization. The technique shown in FIG. 14 may be extended to support more than three pairs of terminals or electrodes.

Figure 15:
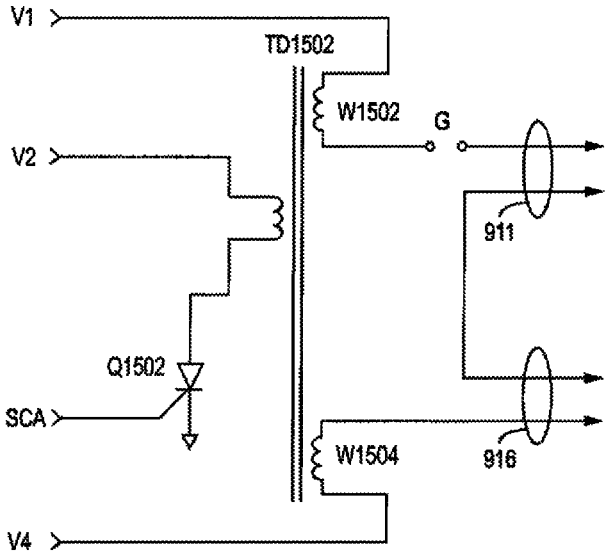
Figure 16:
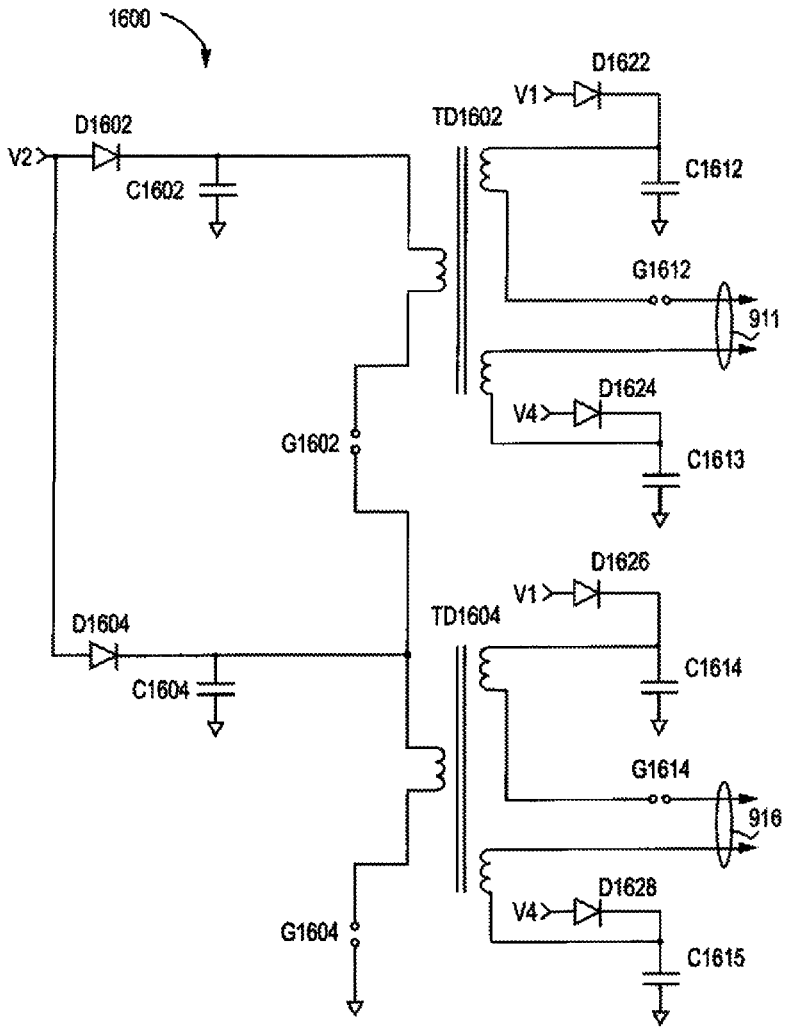
Figure 17:
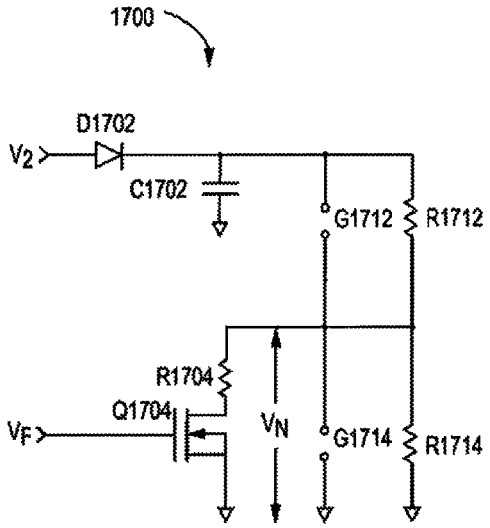
FIG. 17 is a schematic diagram of a switch for stimulus control of the discharge function of FIGS. 7 through 16.

As a second example, transformer TD1502 of FIG. 15 may be substituted for any transformer of any particular stimulate circuit of FIGS. 11, 12, and 13 to support two pairs of terminals or electrodes for that particular stimulate circuit. Transformer TD 1502 includes secondary winding W1502 coupled on one side to a first storage capacitance (e.g., C6) for providing a current through the target after ionization and on the other side to a first terminal or electrode. Transformer TD 1502 further includes a shunt from a second terminal or electrode of the first pair 911 to a third terminal or electrode. Transformer TD 1502 further includes secondary winding W1504 coupled to a fourth terminal or electrode of the second pair 916 and coupled to a second storage capacitance (e.g., C5) for providing a current through the target after ionization. The technique shown in FIG. 15 may be extended to support more than two pairs of terminals or electrodes.

In another stimulus control circuit, according to various aspects of the present invention, several sources of energy are available in the primary circuit. For example, circuit 1600 of FIG. 16 includes capacitors C1602 and C1604 charged to a common voltage (e.g., about 2000 volts). The primary circuit further includes spark gaps G1602 and G1604 each having about 2000 volt break down voltage. When the capacitors are charging or charged, gap G1602 has little if any voltage across it. When charged beyond the break down voltage of gap G1604, terminals or electrodes 916 are active to form a current through the target from charge stored in capacitors C1614 and C1615. Immediately on conduction by gap G1604, the voltage across gap 1602 rises and subsequently causes conduction of gap G1602. On conduction of gap G1602, terminals or electrodes 911 are active to form a current through the target from charge stored in capacitors C1612 and C1613. One advantage of circuit 1600 is that if terminals or electrodes 916 are shorted (e.g., ineffective against a target), a subsequent launch or use of terminals or electrodes 911 will be unaffected because charge for the current for terminals or electrodes 911 is provided by a pair of capacitors (C1612, C1613) different and isolated from capacitors (C1614, C1615) for terminals or electrodes 916.

A switch (e.g., SWA or SWB of FIGS. 8A and 8B) may be implemented for operation or control by a relatively high voltage (e.g., spark gaps G1602 and G1604 of FIG. 16) or a relatively lower voltage. In some implementations semiconductor switches (e.g., operated by signals SCA, SCN of FIGS. 11 through 15) may be desired. For cost and reliability goals, a circuit 1700 of FIG. 17 may be used as a switch in place of any switch of the circuits discussed herein. In operation of circuit 1700, capacitor C1702 is charged to a voltage (e.g., 1000 volts) greater than the break down voltage of gap G1712 but less than the combined break down voltages of gaps G1712 (e.g., 1000 volts) and G1714 (e.g., 300 volts). Spark gap G1712 will conduct when semiconductor FET Q1704 is activated to pull voltage VN of the node between the gaps to near zero volts. As current flows into that node, voltage VN rapidly rises sufficient to cause conduction of gap G1714. The energy of capacitor C1702 is then primarily discharged through the series circuit of gaps G1712, G1714, and any series load (not shown) such as a transformer winding. In effect, a relatively lower voltage signal, the gate firing voltage VF (e.g., about 10 volts or less) controls when capacitor C1702 is discharged through the load. Resistors R1712 and R1714 reduce trapped charge between the spark gaps when the spark gaps cease conducting and override the leakage current of the FET.

Any practical combination of the foregoing structures and methods may be implemented in a device for local stun functions without remote stun capabilities. For example, a device of the shield type having no remote stun functions may include all functions discussed with reference to launch device 102 with the following omissions. The configuration reporting function 142 and launch control function 144 may be omitted from deployment unit control 140. The indicator 112, memory 114, and propellant 116 functions may be omitted from cartridge 105. Interface 107 may be simplified, keeping only signals for terminals of contactor 118. Operator interface 200 or 250 may be implemented without launch state 208. And, launch control functions may be omitted from deployment unit I/O 332.

EXAMPLES OF THE INVENTION

First, an electronic weapon provides at least one of an arcing display and a stimulus signal through a human or animal target to impede locomotion of the target. The weapon cooperates with one or more cartridges. Each cartridge includes at least two wire-tethered electrodes for launching toward the target to provide the stimulus signal; and includes at least two terminals for providing the arcing display. The electronic weapon includes a first user-operated control, a second user-operated control, and a signal generator. The first user-operated control does not initiate a launch of wire-tethered electrodes from any cartridge. When operated for a first duration, the first user-operated control selects one cartridge of the one or more cartridges as a selected cartridge. If the selected cartridge is unused, a second user-operated control initiates a launch function to launch at least two wire-tethered electrodes of the selected cartridge toward a target. When the second control is operated, a signal generator provides the stimulus signal via the launched electrodes of the selected cartridge to impede locomotion by the target. When the first control is operated for a second duration, longer than the first duration, it provides the stimulus signal via the launched electrodes of any cartridge whose electrodes are launched; and, it provides the arcing display between the terminals of any unused cartridge.

In a variation of the first example, the first control is a push button switch and the second control is a trigger switch. The first and second controls are arranged for operation by the same finger of the operator to reduce unintended operations of the electronic weapon (e.g., unintended launch of additional electrodes).

Second, an electronic weapon launches a projectile toward a target to provide a stimulus signal through the target to impede locomotion of the target. The electronic weapon cooperates with one or more projectiles to provide the stimulus signal. Each projectile includes an address, a signal generator, and a receiver that activates the signal generator to provide the stimulus signal upon receipt of the address. The electronic weapon includes a first user-operated control, a second user-operated control, and a transmitter. The first user-operated control does not initiate a launch of any projectile. When operated for a first duration, the first user-operated control selects one projectile of the one or more projectiles as a selected projectile. A second user-operated control initiates a launch function to launch the selected projectile. When the second control is operated, a transmitter transmits the address of the selected projectile to initiate delivery of the stimulus signal by the selected projectile. When the first control is operated for a second duration, longer than the first duration, it transmits the address of all launched projectiles to initiate delivery of the stimulus signal by all launched projectiles.

Third, an electronic weapon provides at least one of an arcing display and a stimulus signal to impede locomotion of a human or animal target. The weapon cooperates with one or more cartridges. Each cartridge includes at least two wire-tethered electrodes for launching toward the target. The electronic weapon includes a first user-operated control, a second user-operated control, and a signal generator. If a selected cartridge is unused, the second user-operated control initiates a launch function of the selected cartridge to launch the at least two wire-tethered electrodes. While the weapon operates in a manual configuration, an operation of the first control for a first duration selects one cartridge of the one or more cartridges as the selected cartridge. When the weapon operates in an automatic configuration, an operation of the second control selects a next unused cartridge of the one or more cartridges as the selected cartridge. The signal generator is responsive to an operation of the first control for a second duration, longer than the first duration, to provide the stimulus signal via the launched electrodes of any cartridge whose electrodes are launched; and, to provide the arcing display via any unused cartridge. The signal generator is responsive to an operation of the second control to provide the stimulus signal via the launched electrodes of the selected cartridge.

Fourth, an electronic weapon provides an arc to warn a human or animal target. The electronic weapon is capable of launching electrodes to impede locomotion of the target by passing a stimulus current through tissue of the target. The electronic weapon cooperates with one or more cartridges installed in the weapon. Each cartridge includes at least two wire-tethered electrodes for launching toward the target; and, at least two cartridge terminals for providing the arc. The electronic weapon includes two or more bays for receiving respective cartridges. Each bay comprises at least two bay terminals. The electronic weapon includes a user-operated control that does not initiate a launch of the at least two wire-tethered electrodes from any cartridge. The electronic weapon includes a signal generator that, responsive to an operation of the control provides a respective arc across the cartridge terminals of all unused installed cartridges and across the bay terminals of all unused bays.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. While for the sake of clarity of description, several specific embodiments of the invention have been described, the scope of the invention is intended to be measured by the claims as set forth below.

What is claimed is:

1. A launch device that impedes locomotion by a target, the launch device for operation with a provided deployment unit installed on or in the launch device, the launch device comprising:

a detector that cooperates with an indicator of the deployment unit to determine indicia describing the deployment unit, wherein the deployment unit deploys an electrode to provide a current through the target to impede locomotion by the target; and a processing circuit that performs a function of the launch device in accordance with the indicia; wherein the detector detects the indicia responsive to a position of the indicator with respect to the detector.

2. The launch device of claim 1 further comprising a display that presents a presentation determined by the processing circuit in accordance with the indicia.

3. The launch device of claim 1 wherein the indicia comprise a quantity of uses.

4. The launch device of claim 1 wherein the indicia comprise a range of effective distances.

5. The launch device of claim 1 wherein the indicia identify a manufacturer.

6. The launch device of claim 1 wherein the function comprises denying activation of a launch.

7. The launch device of claim 1 wherein the function comprises conserving battery power.

8. The launch device of claim 1 wherein the detector provides information to the deployment unit to be stored by the deployment unit.

9. The launch device of claim 8 wherein the information comprises an identity of the launch device.

10. The launch device of claim 8 wherein the information comprises an identity of a user of the launch device.

11. The launch device of claim 8 wherein the information comprises a location of the launch device.

12. The launch device of claim 1 wherein the detector detects the indicia by detecting an electromagnetic signal.

13. The launch device of claim 1 wherein the detector detects a reflection from the indicator.

14. The launch device of claim 1 wherein the detector detects a magnet of the indicator.

15. The launch device of claim 1 wherein the detector detects the indicia by completing a magnetic circuit.

16. The launch device of claim 1 wherein the detector detects the indicia by detecting a modulation.

17. The launch device of claim 1 wherein:

the detector further comprises a source that provides a signal; and the detector detects the indicia by detecting a modulation impressed on the signal by the deployment unit.

18. The launch device of claim 1 wherein:

the indicator comprises a plurality of passive components, each at a respective position with respect to the detector; and the detector detects the indicia in further response to the plurality of components.

19. The launch device of claim 1 wherein:

the launch device further comprises a control; and the processing circuit performs the function in further accordance with the control.

20. The launch device of claim 19 wherein the control provides a range priority.

21. The launch device of claim 19 wherein the control provides an identity of a user of the launch device.

22. A method performed by a launch device that impedes locomotion by a human or animal target, the launch device for operation with a provided deployment unit installed on or in the launch device, the launch device comprising a processing circuit that performs the method, the method comprising:

cooperating with an indicator of the deployment unit to determine indicia describing the deployment unit, wherein the deployment unit deploys an electrode to provide a current through the target to impede locomotion by the target; and performing a function of the launch device in accordance with the indicia; wherein determining the indicia is accomplished in response to a position of the indicator with respect to the launch device.

23. The method of claim 22 further comprising displaying a presentation in accordance with the indicia.

24. The method of claim 22 wherein the indicia comprise a quantity of uses.

25. The method of claim 22 wherein the indicia comprise a range of effective distances.

26. The method of claim 22 wherein the indicia identify a manufacturer.

27. The method of claim 22 wherein the function comprises denying activation of a launch.

28. The method of claim 22 wherein the function comprises conserving battery power.

29. The method of claim 22 further comprising providing information to the deployment unit to be stored by the deployment unit.

30. The method of claim 29 wherein the information comprises an identity of the launch device.

31. The method of claim 29 wherein the information comprises an identity of a user of the launch device.

32. The method of claim 29 wherein the information comprises a location of the launch device.

33. The method of claim 22 wherein cooperating comprises detecting an electromagnetic signal.

34. The method of claim 22 wherein cooperating comprises detecting a reflection from the indicator.

35. The method of claim 22 wherein cooperating comprises detecting a magnet of the indicator.

36. The method of claim 22 wherein cooperating comprises completing a magnetic circuit with the indicator.

37. The method of claim 22 wherein cooperating comprises detecting a modulation.

38. The method of claim 22 wherein cooperating further comprises detecting the indicia in response to sourcing a signal to the deployment unit.

39. The method of claim 22 wherein:

the indicator comprises a plurality of passive components, each at a respective position with respect to the detector; and cooperating comprises determining the indicia in further response to the plurality of components.

40. The method of claim 22 wherein performing the function is accomplished in further accordance with a control of the launch device.

41. The method of claim 40 wherein the control provides a range priority.

42. The method of claim 40 wherein the control provides an identity of a user of the launch device.

* * * * *